US008830023B2

(12) United States Patent
Darr

(10) Patent No.: US 8,830,023 B2
(45) Date of Patent: Sep. 9, 2014

(54) CONFIGURABLE FUSE BLOCK ASSEMBLY AND METHODS

(75) Inventor: Matthew Rain Darr, Edwardsville, IL (US)

(73) Assignee: Cooper Technologies Company, Houston, TX (US)

( * ) Notice: Subject to any disclaimer, the term of this patent is extended or adjusted under 35 U.S.C. 154(b) by 360 days.

(21) Appl. No.: 13/176,330

(22) Filed: Jul. 5, 2011

(65) Prior Publication Data

US 2012/0019344 A1 Jan. 26, 2012

Related U.S. Application Data

(60) Provisional application No. 61/366,217, filed on Jul. 21, 2010.

(51) Int. Cl.

| | |
|---|---|
| ***H01H 85/20*** | (2006.01) |
| ***H01H 85/22*** | (2006.01) |
| ***H01H 85/54*** | (2006.01) |
| *H01H 85/25* | (2006.01) |
| *H01H 9/02* | (2006.01) |
| *H01H 11/00* | (2006.01) |

(52) U.S. Cl.

CPC ..... *H01H 85/204* (2013.01); *H01H 85/25* (2013.01); *H01H 9/0264* (2013.01); *H01H 2085/207* (2013.01); *H01H 11/0031* (2013.01); *H01H 2085/2065* (2013.01); *H01H 2085/209* (2013.01)

USPC ..... 337/201; 337/186; 337/187; 337/188

(58) Field of Classification Search

USPC ..... 337/186–188, 201

See application file for complete search history.

(56) References Cited

U.S. PATENT DOCUMENTS

| | | | | |
|---|---|---|---|---|
| 846,691 | A * | 3/1907 | Painter | 337/205 |
| 3,678,432 | A * | 7/1972 | Boliver | 337/201 |
| 3,742,413 | A * | 6/1973 | Taylor | 337/201 |
| 4,536,046 | A | 8/1985 | Erickson | |
| 4,613,195 | A * | 9/1986 | Suher et al. | 439/166 |
| 6,753,754 | B1 | 6/2004 | Black et al. | |
| 7,515,031 | B2 * | 4/2009 | Jakobsen et al. | 337/187 |
| 2004/0021547 | A1 * | 2/2004 | Vicenza et al. | 337/186 |
| 2009/0243786 | A1 | 10/2009 | Buettner | |
| 2012/0019345 | A1 * | 1/2012 | von zur Muehlen | 337/214 |

FOREIGN PATENT DOCUMENTS

| | | | |
|---|---|---|---|
| DE | 730252 | C | 1/1943 |
| DE | 922360 | C | 1/1955 |
| DE | 1804381 | U | 1/1960 |
| DE | 2506365 | A1 | 8/1976 |
| DE | 29906759 | U1 | 7/1999 |
| DE | 19836154 | A1 | 4/2000 |

OTHER PUBLICATIONS

International Search Report and Written Opinion of PCT/US2011/044608; Mar. 22, 2012; 21 pages.

* cited by examiner

*Primary Examiner* — Anatoly Vortman
(74) *Attorney, Agent, or Firm* — Armstrong Teasdale LLP

(57) ABSTRACT

Modular fuse block assemblies configurable to accommodate overcurrent protection fuses of different physical sizes. Single and multi-pole blocks may be easily assembled from a reduced number of modular parts than would otherwise be required, with enhanced safety features and improved capability to meet spacing requirements in a multi-pole fuse block.

41 Claims, 13 Drawing Sheets

CONFIGURABLE FUSE BLOCK ASSEMBLY AND METHODS

CROSS-REFERENCE TO RELATED APPLICATIONS

This application claims the benefit of U.S. Provisional Patent Application Ser. No. 61/366,217 filed Jul. 21, 2010, the disclosure of which is hereby incorporated by reference in its entirety.

BACKGROUND OF THE INVENTION

The field of the invention relates generally to fuseholders or fuse blocks, and more specifically to modular fuse blocks adaptable for use with more than one of a plurality of overcurrent protection fuses having different current ratings and opposed, axially extending terminals of different physical size.

Fuses are overcurrent protection devices for electrical circuitry, and are widely used to protect electrical power systems and prevent damage to circuitry and associated components when specified circuit conditions occur. A fusible element or assembly is coupled between terminal elements of the fuse, and when specified current conditions occur, the fusible element or assembly melts or otherwise structurally fails and opens a current path between the fuse terminals. Line side circuitry may therefore be electrically isolated from load side circuitry through the fuse, preventing possible damage to load side circuitry from overcurrent conditions.

A variety of different types of overcurrent protection fuses are known and utilized in electrical power systems. In any given electrical power system, fuses of different electrical ratings may be utilized and various terminations options may be necessary complete electrical circuits through the fuses with connecting wires. As fuses of different ratings typically vary in a physical package size from one another, so do the fuse blocks that are used in combination with differently rated fuses. This typically results in somewhat customized fuse blocks for fuses of certain ratings and also for desired type of terminations, and a large inventory of parts is typically required to meet wide ranging needs in the field. Improvements are desired.

A considerable variety of overcurrent protection fuses are known in the art and have been used to some extent with a corresponding variety of fuseholders or fuse blocks. Conventionally, fuseholders tend to be designed to accommodate specific types and sizes of fuses only. That is, conventional fuse holders are constructed with a certain type of fuse in mind (e.g., cylindrical fuses versus rectangular bodied fuses), having certain ratings (e.g. voltage and current ratings) and certain types of terminations (e.g., ferrules versus blade contacts). Such conventional fuseholders generally lack any flexibility to accommodate other types of fuses, or other sizes of fuses.

Some known fuse holders are provided in modular form that may be assembled into larger fuse blocks, and thus may accommodate different numbers of fuses relatively easily. For example, U.S. Pat. No. 6,431,880 is commonly owned with the present application and discloses modular body sections coupled to one another, and a power bus common to all of the body sections. The fuse block of U.S. Pat. No. 6,431,880 is designed for use with ATC™ automotive blade-type fuses of Cooper Bussmann, St. Louis Mo. Such blade-type fuses include parallel terminal blades extending from a common side of a thin, rectangular, insulating housing, and a fuse element extending between the terminal blades at an interior location in the housing. The aforementioned ATC™ blade-type fuses are available with voltage ratings of 32V DC (or less) and current ratings of 1 to 40A. Typical of blade-type fuses, ATC™ fuses of different ratings are provided in the same physical package (i.e., the fuse housing and the terminal blades are typically of the same size and shape), and hence are color coded and marked so that the different ratings can easily be distinguished from one another.

For higher powered electrical systems, square or cylindrical bodied fuses are known having more substantial terminal elements extending axially from opposed ends of the fuse bodies, and also more substantial fuse elements for the increased demands of higher power applications. For example, cylindrical Class J fuses, Class R fuses, and Class H(K) fuses are available having voltage ratings of, for example 250V AC or 600V AC and current ratings of 100A, 200A, 400A or 600A. Such cylindrical fuses may include ferrules or knife blade contacts extending axially from opposing ends of the cylindrical, insulative fuse body, with a fuse element or assembly extending between the ferrules or knife blades interior to the fuse body. Ferrule type fuses are also known having current ratings of about 100A or less.

Unlike the blade-type fuses discussed above, the square or cylindrical bodied fuses of different ratings involve varying physical package size. That is the square or cylindrical bodies vary in diameter and axial length, and the associated ferrules or knife blade contacts extending from opposite ends of the fuse bodies have different proportions for differently rated fuses. Cylindrical fuses of smaller ratings typically have smaller diameter and shorter bodies relative to cylindrical fuses of larger ratings, and the ferrules and/or knife blade contacts are smaller in fuses having smaller ratings. Likewise, square bodied fuses of smaller ratings would have bodies with smaller sides relative to square bodied fuses having larger current ratings, and the knife-blade contacts would be smaller in fuses having lower current ratings.

FIG. 24 illustrates an exemplary fuseholder 100 for use with cylindrical bodied fuses having opposed, axially extending terminals. The fuseholder 100 is accordingly configured to accommodate a fuse 102 having a generally cylindrical body 104 and conductive terminal elements 106 and 108. In various embodiments, the fuse 102 may be a Class J fuse, Class R fuse, or Class H(K) fuse rated at 600V AC (or less) and having current ratings of 100A to 600A. A fuse element completes a conductive path interior to the body 100 between the conductive terminal elements 106 and 108, which may include knife blade terminal contacts as shown. The terminal elements 106 and 108 of the fuse 102 are received by terminals 110 and 112 that define fuse clips to receive the fuse terminal elements 106, 108 and also define termination structure to establish line side and load side electrical connections to electrical circuitry of an electrical power system. The line side and load side connections to the fuse holder 100 are typically established with wires using any one of a variety of techniques known in the art, such as, for example, terminal screws and/or box lug terminals accepting stripped wire ends, ring terminals, etc.

The terminals 110 and 112 of the fuseholder 100 are further provided on a nonconductive base piece 114 that may be configured for mounting to an electrical panel, chassis, or other support structure via a mounting bore 116 and a fastener (not shown). Nonconductive barrier elements 118, 120, 122 and 124 may be provided to form partial compartments for the line and load side terminals 110, 112. In the example shown, the barrier elements 118, 120, 122 and 124 extend generally perpendicular to a plane of the base piece 114 and extend only adjacent the line and load side terminal elements 110, 112, while leaving the fuse body 104 generally exposed. As such, a technician can grasp the body 104 of the fuse 102 by hand and extract it from the line and load side terminals 110, 112 without being hindered by the barrier elements 118, 120, 122 and 124.

A number of fuseholders 100 may be individually mounted side-by-side to form a multi-pole fuse block, with the barrier elements 118, 120, 122, 124 separating adjacent line and load side terminals 110, 112 in the adjacent fuse holders in the block. Some degree of protection is therefore provided against inadvertently shorting the line or load side terminals as the fuse blocks are serviced. The barrier elements 118, 120, 122, 124 also offer some protection against a risk of electrical shock via inadvertent contact by a technician's fingers, and some degree of "finger safe" operation is therefore provided. However, while the barrier elements 118, 120, 122, 124 provide some assurance against inadvertent contact with the line and load side terminals 110, 112 from the side (i.e., in a direction parallel to the plane of the base piece 114), it is still possible to contact the terminals 110, 112 from above (i.e., in a direction perpendicular to the plane of the base piece 114), whether with a user's fingers or tools.

As previously mentioned, differently rated cylindrical fuses tend to entail different physical package sizes. For example, considering class J fuses rated at 600V, a 100A fuse entails a first diameter and length of the fuse body 104, while a 200A fuse entails a second and larger diameter and length of the fuse body, as well as correspondingly larger terminal elements 106 and 108. Likewise a 400A rated fuse and a 600A rated fuse would entail increasingly larger circumferences and lengths of the cylindrical bodies 104 and still larger terminal elements 106 and 108. Large variations in size across the differently rated fuses are typical. Consequently, because of variations in the dimensions of such differently rated fuses, the fuseholder 100 is typically designed to accommodate one and only one of such differently rated fuses. In other words, differently rated fuses are not interchangeably used with the fuseholder 100, and instead a number of differently dimensioned fuseholders 100 must be produced and provided to accommodate the differently rated and differently sized fuses.

Considering the variety of fuse ratings available for cylindrical bodied fuses, and the corresponding variation in physical size, a large variety of fuseholders 100 would be necessary to provide full range of fuse blocks for use in a complex electrical power system. A rather large inventory of fuse blocks must be produced, stored and made available on site at the electrical power system, at some cost to technicians. If a fuse block of the proper size is not available, delays to full protection of an electrical system may result at even further cost. Still further, confusion can arise due to a relatively large number of available sizes of fuse blocks, leading to potential mistake in stocking and maintaining inventories, as well as installing and maintaining fuse blocks in the field.

Further compounding the issues above is the variety of termination options available for the fuseholder 100. Because the line and load side termination features tend to be integrally provided with the fuse clips, different line and load side terminals 110, 112 are necessary to provide different termination structures. In combination with dimensional differences of differently rated fuses, a large number of differently configured terminals 110, 112 may result, each of which must also be inventoried, stocked and maintained. For the exemplary fuseholder 100 depicted, ninety-one (91) total component parts have been found necessary to accommodate a set of fuses of different ratings and different termination options. Considerable cost and effort results in producing, stocking and managing such a large inventory of parts.

Still another disadvantage of the fuseholder 100 is that, when used to form larger fuse blocks having multiple poles, satisfying applicable UL specifications or IEC specifications concerning the spacing of the fuses in the blocks is difficult. For example, UL specifications (specifically UL Specification 4248) or counterpart IEC specifications may require specific positioning of the fuses in the block to achieve a minimum space or distance between energized or "live" connecting terminals in use. To satisfy such specification, a certain clearance is required between the connecting terminals such that the terminals are separated by a certain distance through air, or alternatively by another and larger distance measured on the surface of the fuseholder. The fuseholder 100 generally lacks a flexibility to meet such spacing or clearance requirements with certainty, and in some cases renders the satisfaction of such specifications difficult or impossible.

Fuseholders for square bodied fuses, such as NH fuses that those in the art would no doubt recognize, are also known and are subject to similar problems as the fuseholder 100 described above.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Exemplary modular fuse block assemblies are disclosed hereinbelow that overcome numerous difficulties and disadvantages in the art as described above.

More specifically, exemplary embodiments of modular fuse blocks will now be described that among other things, dramatically reduce the number of components parts needed to produce a large variety of fuse blocks for a plurality of fuses having different ratings, provide an enhanced degree of safety to technicians in the field, provide versatile adaptability to different termination options, and provide enhanced capability to meet UL and IEC specifications that may apply. Lower cost and more widely applicable fuse blocks may result that avoid a need for customized and higher cost fuse blocks in common use.

As explained in detail below, these and other benefits are realized with a dramatically reduced number of modular, substantially interchangeable and rather easily assembled parts or components to capably configure a fuse block to accommodate a selected one of a set of fuses having varying physical size and ratings, with a desired termination structure and while satisfying application IEC or UL specifications. Related methodology will be in part explained and in part apparent from the following discussion and the drawings provided, which may include appropriate modification by those in the art within the scope and spirit of the appended claims.

Figure 1:
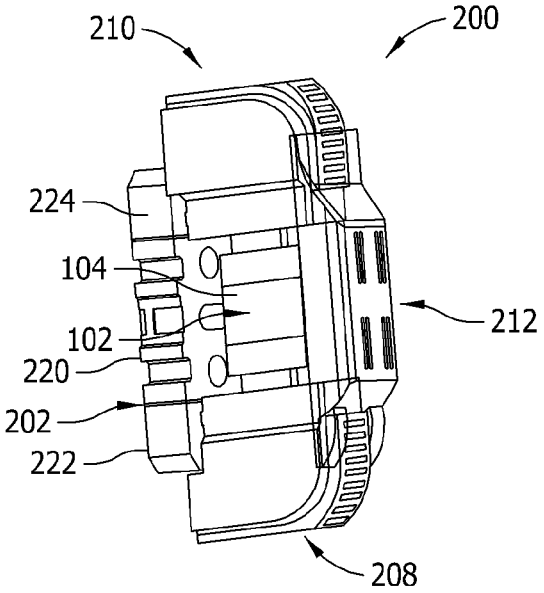
FIG. 1 is a perspective view of an exemplary modular fuse block assembly with an overcurrent protection fuse.
Figure 2:
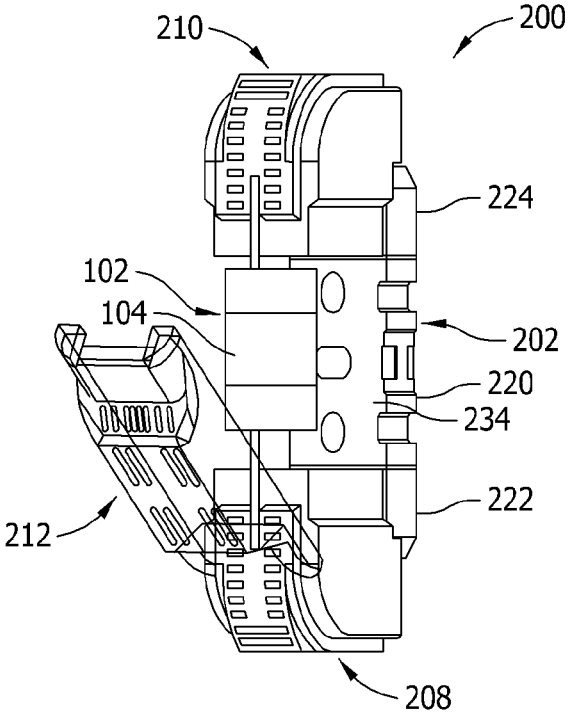
FIG. 2 is another perspective view of the assembly shown in FIG. 1.
Figure 3:
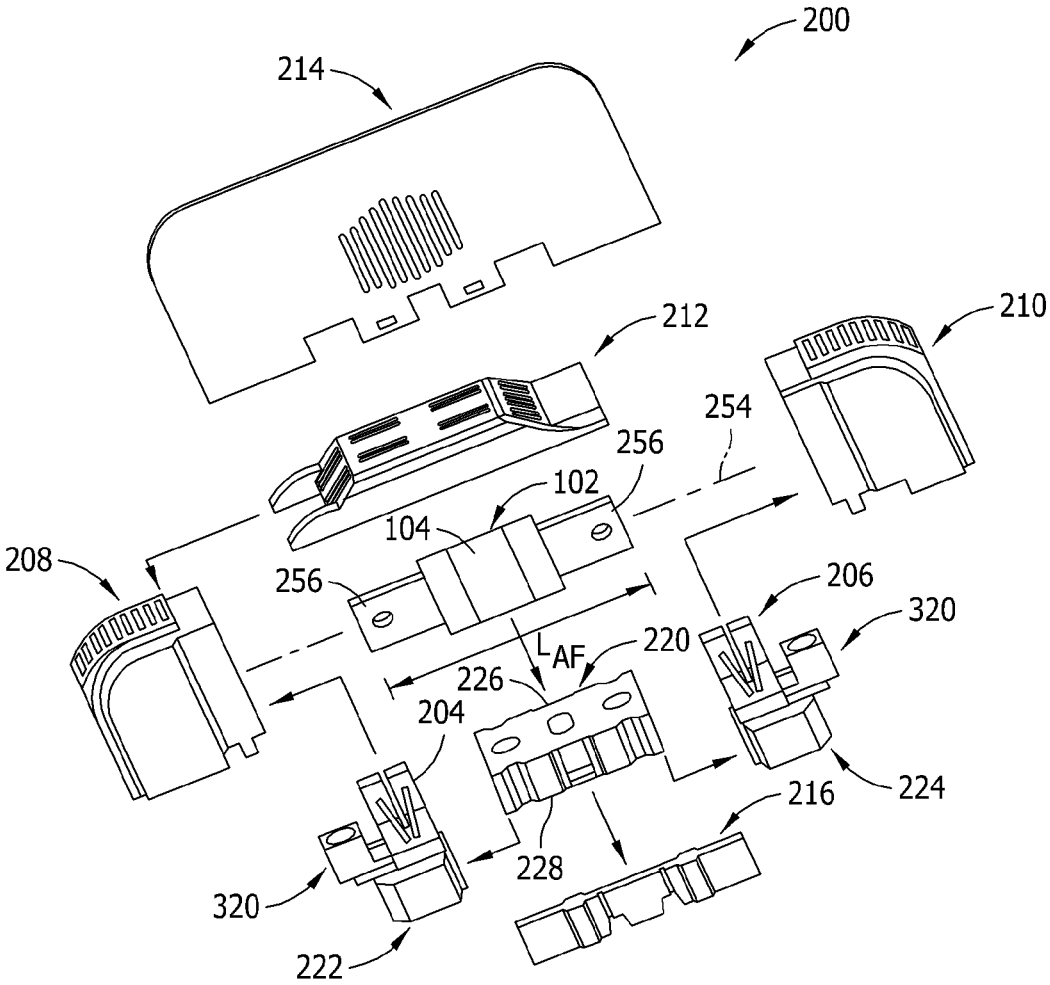
FIG. 3 is an exploded view of the assembly shown in FIG. 1.

FIG. 1-3 are various views of an exemplary modular fuse block assembly 200 accommodating the overcurrent protection fuse 102 previously described. While the fuse 102 depicted includes a cylindrical body in the illustrated embodiments, the fuse body may also be square or otherwise shaped in alternative embodiments with similar benefits. That is, the particular exemplary fuses shown in the Figures are provided for the sake of illustration rather than limitation.

The fuse block assembly 200 includes, as shown, a configurable base assembly 202 (FIGS. 1 and 2) formed from modular components described below, modular line and load side fuse clips 204, 206 (FIG. 3), modular terminal covers 208 and 210, a fuse cover 212 that may also be modular, a modular phase barrier 214 (FIG. 3), and a modular spacer interconnect element 216 (FIG. 3). The assembly 200 may be duplicated to form multi-pole fuse blocks such as those shown in FIGS. 22 and 23 and later described.

As shown in FIGS. 1 and 2, the configurable base assembly 202 may be mounted to a supporting surface, such as a wall, panel, chassis, DIN rail or other support structure, with the fuse cover 212 generally opposing the base assembly 202 and overlying the fuse 102 from the front of the block 200. As shown in FIGS. 1 and 2, the sides of the fuse block 200 are open, however, and the fuse body 104 is generally exposed from the side between the terminal covers 208 and 210. The terminal covers 208 and 210 generally enclose or surround, from the front and from the sides, the live electrical connections to the fuse 102 and provide an enhanced degree of safety to those tasked with installing or replacing the fuse 102.

The fuse cover 212 is movable between a closed position (FIG. 1) generally blocking access to the fuse 102, and an opened position (FIG. 2) permitting access to the fuse 102 for removal and replacement when the fuse element has opened in the fuse 102 so that the fuse 102 no longer conducts current and effectively opens the circuit through the fuse 102. In the exemplary embodiment illustrated, the fuse cover 212 is pivotally mounted to the terminal cover 208 at one end as further described below, although the fuse cover 212 may be differently mounted in alternative embodiments.

Figure 4:
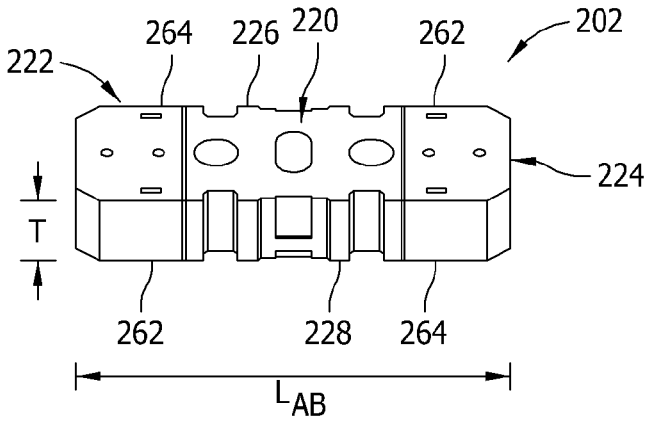
FIG. 4 is a perspective view of an exemplary modular and configurable base assembly for the modular fuse block shown in FIGS. 1-3.
Figure 5:
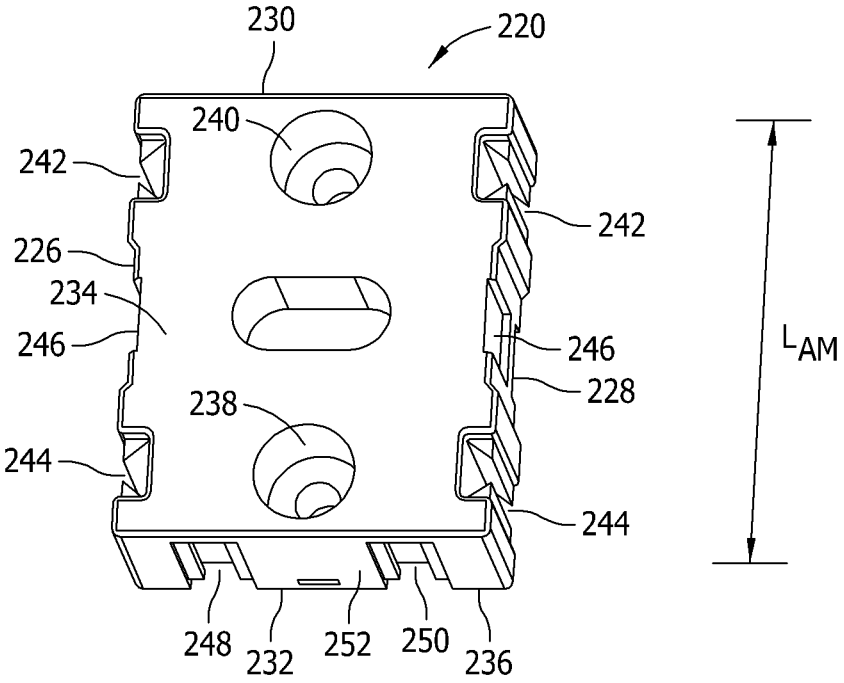
FIG. 5 is a perspective view of an exemplary main mounting base section for the configurable base assembly shown in FIG. 4.
Figure 6:
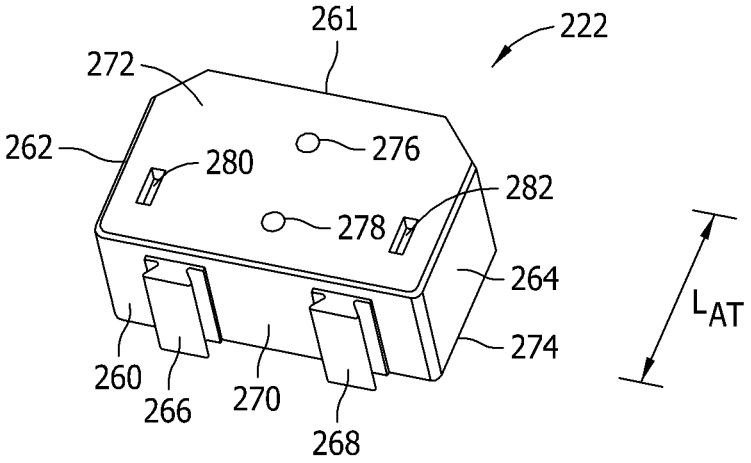
FIG. 6 is perspective view of an exemplary terminal base section for the configurable base assembly shown in FIG. 4.

The configurable base assembly 202, as further shown in FIGS. 4-6, is constructed in the example shown from three separately provided component parts, namely a modular main base section 220 and modular terminal base sections 222 and 224 that are attached to either opposing end of the main base section 220. The main base section 220 and the terminal base sections 222 and 224 may each be fabricated from a suitable nonconductive material known in the art, such as plastic, and may be formed in the shapes depicted using known processes such as molding. While the multi-piece base construction having at least three sections is believed to be advantageous for the reasons described below, in another embodiment the base could be fabricated as a single piece, and when used in combination with the other modular components described herein would achieve at least some of the benefits described to varying degrees. Likewise, it is contemplated that at least some of the benefits of the invention could be achieved using only two base sections assembled to one another. As a further variation, more than three base sections may be utilized.

As best shown in the exemplary embodiment of FIG. 5, the main base section 220 is substantially rectangular and includes generally elongate and contoured longitudinal sides 226, 228 and shorter, but still contoured, lateral sides 230, 232 interconnecting the longitudinal sides 226, 228. Opposing top and bottom surfaces 234, 236 are substantially flat and planar and generally parallel to one another. Mounting bores 238, 240 extend completely through the main base section 220 for mounting to a support structure using a fastener (not shown). Alternatively, the main base section 220 may be configured for mounting to a DIN rail or other support structure in a manner that does not require fasteners. When mounted and in use, the bottom surface 236 faces the support structure and the top surface 234 (also shown in FIG. 2) faces the cylindrical body 104 of the fuse. Also, the longitudinal sides 226, 228 extend parallel to the longitudinal axis 254 (FIG. 3) of the fuse 102 when assembled.

In the example shown, the longitudinal sides 226, 228 of the main base section 220 each include shaped grooves or slots 242, 244 extending on either side of a central attachment section 246. As such, the longitudinal sides 226, 228 are each configured for interlocking attachment with complementary features of the spacer interconnect element 216 (shown in FIG. 3 and described further below in relation to FIG. 13). That is, the spacer interconnect element 216 may be interfitted with either of the longitudinal sides 226, 228 with tongue and groove, sliding engagement having positive stop or dead stop engagement to prevent inadvertent disengagement of the elements by passing the tongues completely through the grooves in the interlocking pieces. Assembly of the main base section 220 and the spacer interconnect element 216 may be accomplished easily be hand without a need for tools by aligning the complementary features of the components and sliding them together until securely interlocked.

The lateral sides 230 and 232 of the main base section likewise each include shaped grooves or slots 248, 250 extending on either side of a central attachment section 252. As such, the lateral sides 230 and 232 are each configured for interlocking attachment with complementary features of the terminal base sections 222 and 224 (shown in FIGS. 3 and 4 and further described below in relation to FIG. 6). That is, the lateral sides 230 and 232 of the main base section 220 may be interfitted with either of the terminal base sections 222, 224 with tongue and groove, dead stop, sliding engagement as described above. Assembly of the main base section 220 and the terminal base sections 222, 224 may be accomplished easily be hand without a need for tools by aligning the complementary features of the components and sliding them together until securely interlocked.

The main base section 220 has a first axial length $L_{AM}$ that is aligned with a longitudinal center axis 254 (FIG. 3) of the fuse 102 when the block 200 is assembled. In the exemplary embodiment shown $L_{AM}$ is slightly longer than an axial length of the fuse body 104 measured along the center axis 254. In an alternative embodiment wherein the fuse 102 includes ferrules only rather than the ferrules including knife blade contacts 256 (FIG. 3), $L_{AM}$ may be shorter than the axial length of the fuse body 104.

As shown in FIG. 3, the knife blade contacts 256 of the fuse 102 extend axially away from the corresponding ends of the fuse body 104, thereby increasing an overall axial length of the fuse well beyond the axial length of the fuse body 104 to an overall axial length $L_{AF}$ (FIG. 3) measured from distal end to distal end of the knife blade contacts 256. Generally speaking, for a fuse 102 of a given rating, a fuse having knife blade contacts 256 will have an overall axial length $L_{AF}$ measured end-to-end that is greater than fuses having ferrules only. For fuses including ferrules only, the overall axial length of the fuse 102 would typically be nearly equal to the axial length of the cylindrical fuse body 104. Regardless of whether ferrules only or knife blade contacts are provided on the fuse 102, however, the first axial length $L_{AM}$ of the main base section 220 is less than the overall axial length $L_{AF}$ of the fuse 102. The axial length $L_{AM}$ of the modular main base section 220 may be strategically selected to provide a desired amount of spacing of the fuse clips 204 and 206 (FIG. 3) in a direction parallel to the axial length $L_{AF}$ of the fuse 102 for a fuse of a given rating.

An exemplary terminal base section 222 for the configurable base assembly 202 (FIG. 3) is shown in detail in FIG. 6, and in the example shown in the Figures the terminal base section 224 (FIG. 3) is substantially identically formed but arranged in a mirror-image configuration to the terminal base section 222 on the opposing side of the main base section 220. In another embodiment, however, the terminal base sections 222, 224 need not be the same.

The terminal base section 222 as shown in FIG. 6 also includes lateral sides 260, 261 and longitudinal sides 262, 264. One of the lateral sides 260 includes tongues or protrusions 266, 268 on either side of a central attachment section 270. The tongues 266, 268 and the attachment section 270 of the terminal base 222 are shaped complementary to the groves 248, 250 and the attachment section 252 (FIG. 5) of the main base section 220. As such, when the lateral side 260 of the terminal base section 222 is aligned with the lateral side 232 of the main base section 220, the lateral sides 260, 232 may be interlocked and interfitted with tongue and groove, sliding engagement as shown in FIGS. 3 and 4. When so assembled, the longitudinal sides 226, 228 (FIG. 5) of the main base section 220 generally align with the longitudinal sides 262, 264 of the terminal base sections 222, 224 as best shown in FIG. 4. The opposing lateral side 261 of the terminal base section 222 is generally flat and without contour, and defines a distal end of the base assembly 220 (FIGS. 3 and 4) when assembled.

The longitudinal sides 262, 264 of the terminal base section 222 are generally flat and without contour in the exemplary embodiment illustrated, and have an axial length $L_{AT}$ that is, in the example illustrated, less than the axial length $L_{AM}$ (FIG. 5) of the main base section 220. When both the terminal base sections 222 and 224, which are identically constructed in the exemplary embodiment shown, are attached to the main base section 220 as shown in FIG. 4, the axial length $L_{AB}$ of the resultant base assembly 202 (shown in FIG. 4) is equal to the sum of the axial length $L_{AM}$ of the main section 220, and the axial lengths $L_{AT}$ of the terminal base sections 222 and 224, which may be same or different from one another in various embodiments. The axial length $L_{AB}$ of the base assembly 202 is greater than the overall axial length $L_{AF}$ (FIG. 3) of the fuse 102.

While the exemplary base assembly 202 shown and thus far described has three parts, additional parts may be introduced. As one example, the main base section 220 as depicted may itself be fabricated and assembled from more than one section. Because the parts in the base assembly 202 are attached end-to-end, however, regardless of how many base component parts are utilized, the axial length $L_{AB}$ of the base assembly 202 will be equal to the sum of the axial lengths of the parts used. As such, with some strategic selections of the respective axial lengths of the sections 220, 222 and 224, different overall axial lengths $L_{AB}$ of the base assembly 202 may be provided. Various axial lengths of the base assembly $L_{AB}$ are possible as will be apparent from the following description.

It is contemplated that a set of modular main base sections 220 having different axial lengths $L_{AM}$ may be provided, and also a set of modular terminal base sections 222, 224 having different axial lengths $L_{AT}$ may also be provided. By selecting appropriate axial lengths $L_{AM}$ and $L_{AT}$ of the respective main base sections 220 and terminal base sections 222, 224 of the sets, the resultant axial length $L_{AB}$ of the base assembly 202 may be varied considerably and the same sets of modular parts may be arranged to accommodate a variety of fuses 102 having different ratings and physical size.

As one example, eleven different main base sections 220 with various axial lengths, and two different terminal base sections 222, 224 having different axial lengths can be used in various combinations to configure the fuse block 200, and specifically the base assembly 202, with various axial spacing between the fuse clips 204, 206 to accommodate, for example, Class J, Class H & R, and Class H (K) cylindrical fuses of having voltage ratings of 250 V to 600 V, and current ratings of 100 A to 600 A, as set forth in the following Table 1.

TABLE 1

| Base Section 220 | Axial Spacing (in.) | Fuse Class | Fuse Rating (V) | Fuse Rating (A) |
|---|---|---|---|---|
| Main 1 | 2.75 | J | 600 | 100 |
| Main 2 | 3.5 | J | 600 | 200, 400 |
| Main 3 | 3.875 | J | 600 | 600 |

TABLE 1-continued

| Base Section 220 | Axial Spacing (in.) | Fuse Class | Fuse Rating (V) | Fuse Rating (A) |
|---|---|---|---|---|
| Main 4 | 4.0 | H(K) & R | 250 | 100 |
| Main 5 | 6.0 | H(K) & R | 600 | 100 |
| Main 6 | 4.5 | H(K) & R | 250 | 200 |
| Main 7 | 7.0 | H(K) & R | 600 | 200 |
| Main 8 | 5.0 | H(K) & R | 250 | 400 |
| Main 9 | 8.0 | H(K) & R | 600 | 400 |
| Main 10 | 6.0 | H(K) & R | 250 | 600 |
| Main 11 | 9.0 | H(K) & R | 600 | 600 |

In one embodiment, the axial spacing of Table 1 provided for each fuse and rating is determined predominately by the axial length of the main base sections 220 (i.e., Main 1 through Main 11 in Table 1). That is, the axial length of the main base sections 220 would be approximately equal to the axial spacing value shown in Table 1.

In other embodiments, the axial spacing shown in Table 1 could achieved in part by the terminal base sections 222, 224 as well, and in such a case the axial length of the main base sections 220 (i.e., Main 1 through Main 11) would be less than the corresponding axial spacing values shown in Table 1, with the terminal base sections 222, 224 providing the difference.

Actual dimensions for the main base sections 220 and terminal sections 222, 224 may vary in different embodiments while accomplishing the same objective of providing the axial spacing values of Table 1 in one example. Numerous embodiments of differently proportioned base sections 220, 222 and/or 224 are possible to meet the spacing values in Table 1 or other values as desired.

Figure 24:
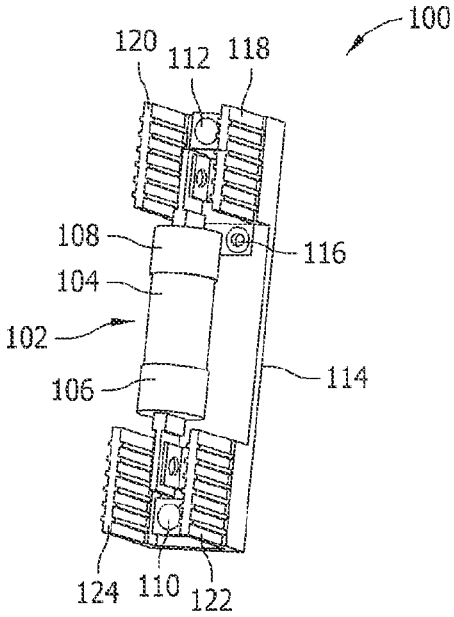
FIG. 24 PRIOR ART
FIG. 24 is a perspective view of an exemplary known fuse block.

The combinations of main base sections 220 and terminal base sections 222, 224 represented above yield approximately a 50% reduction in the number of parts needed to accommodate the same fuses using the fuseholder 100 (FIG. 24) discussed above. Considerable savings are realized with reduced manufacturing costs, reducing a necessary inventory of parts, and necessary storage space, effort and labor cost to manage a reduced number of components. Further, the base assemblies 202 can be rather quickly and easily configured either at the manufacturer level, distributor level, or even from the field in using a relatively low number of parts to accommodate a full line of fuses.

Despite the various axial lengths $L_{AM}$ of main base sections 220 in the above examples, the width of the main base sections 220, measured in a direction perpendicular to the axial length $L_{AM}$ and in a plane parallel to the major surfaces 234, 236 (FIG. 5) of the base sections 220, may be substantially constant. The spacer interconnect element 216 (FIG. 3) may be used with the main base sections 220 in the width dimension for additional spacing of components in the width direction as further explained below.

Referring back to FIG. 6, the terminal base section 222 (to which the terminal base section 226 may be substantially identical) further includes top and bottom major surfaces 272 and 274. Openings 276, 278 are provided for mounting of the fuse clips 204 and 206 (FIG. 3), and openings 280 and 282 are provided for mounting of the terminal covers 208, 210 (FIG. 3). The openings 276, 278, 280, 282 extend completely through the terminal base section 222 such that the terminal base section 222 may be attached to either lateral side 230 or 232 (FIG. 5) of the main base section 220 to form the base assembly 202. In the example shown, the openings 276, 278 are arranged in approximately centered but spaced apart locations along the longitudinal axis $L_{AT}$, while the openings 280, 282 are aligned with one another and spaced apart in a direction transverse to the longitudinal axis $L_{AT}$. Further, the openings 276, 278 are generally circular, while the openings 280, 282 are rectangular. Other arrangements and shapes of the openings are, of course possible, as well as greater or fewer numbers of openings in other embodiments.

As best seen in FIG. 4, the entire base assembly 202 in the example shown has a uniform thickness T. That is, the main base section 220 and the terminal base sections 222, 224 are each formed with a substantially equal thickness, measured in a direction perpendicular to the plane of the major surfaces (i.e. the surfaces 232, 234 of the main base section 220 and the surfaces 272, 274 of the terminal sections 224, 224) of the sections utilized to configure the base assembly 202. In further and/or alternative embodiments, however, the sections 220, 222 and 224 could be formed with different thicknesses.

Figure 7:
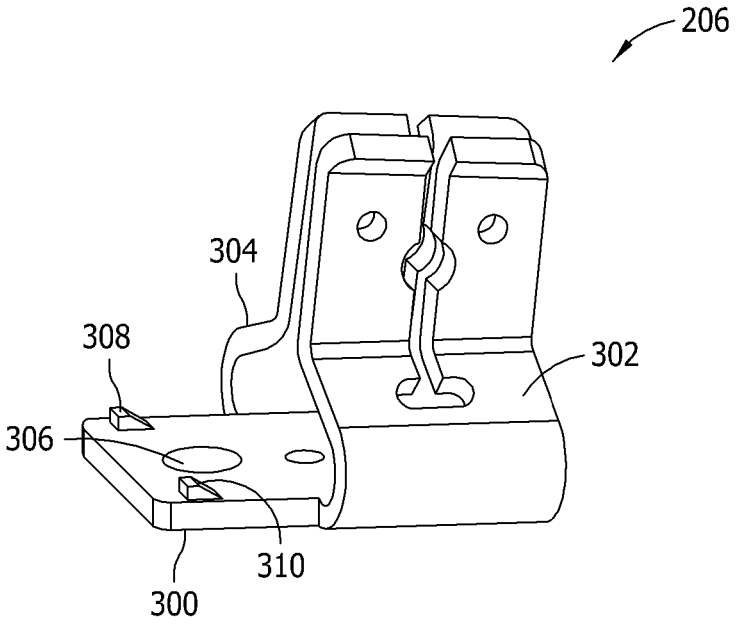
FIG. 7 is a perspective view of an exemplary fuse clip for the terminal base shown in FIG. 6.
Figure 8:
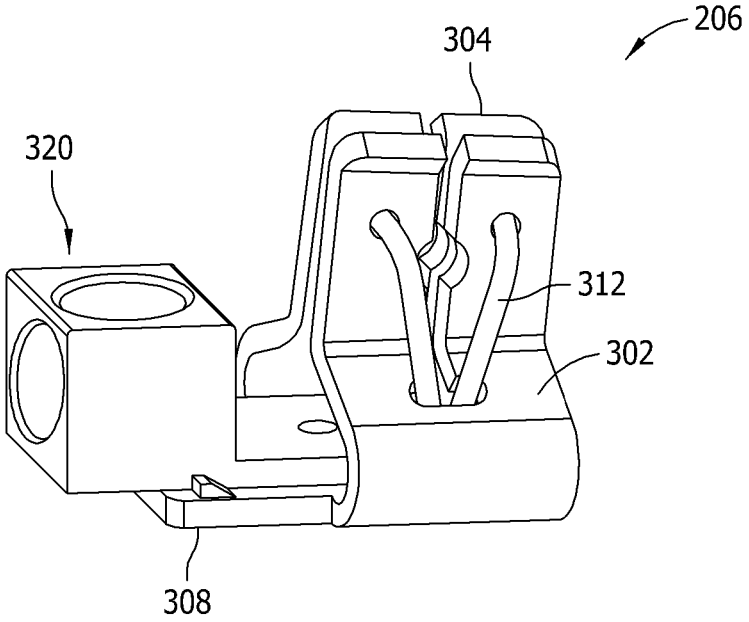
FIG. 8 is a perspective view of the fuse clip shown in FIG. 7 provided with a box lug terminal.
Figure 9:
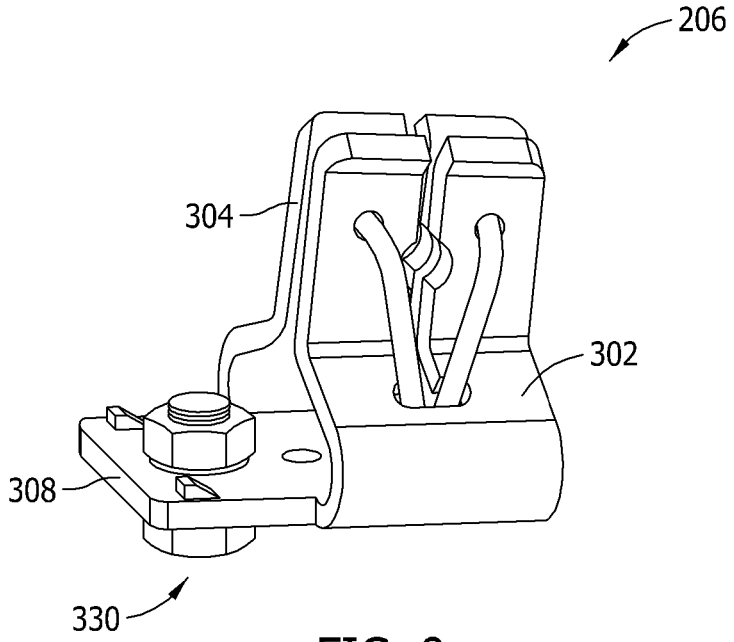
FIG. 9 is a perspective view of the fuse clip shown in FIG. 7 provided with a terminal stud.
Figure 10:
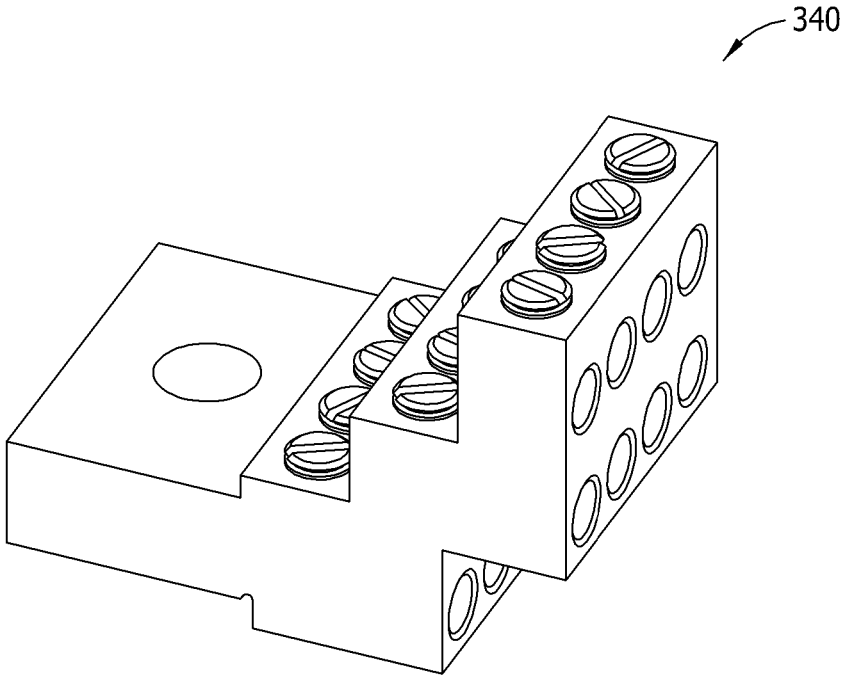
FIG. 10 is a perspective view of a power distribution box lug terminal that may be used with the fuse clip shown in FIG. 7.

FIG. 7 illustrates the fuse clip 206 (also shown in FIG. 3) which in an exemplary embodiment is fabricated from a conductive material according to known techniques to include a base plate 300 and upstanding fuse clip members 302, 304 extending therefrom. One of the knife blade contacts 256 (FIG. 3) may be inserted between the ends of the fuse clips members 302 and 304 to establish secure mechanical and electrical connection to the knife blade contacts 256. A resilient spring element 312 (shown in FIG. 8) may be attached to the fuse clip members 302, 304 to provide a biasing force ensuring mechanical and electrical contact, as well as to securely retain the knife blade contacts 256 when inserted. Because the size of the knife blade contacts 256 increases with higher current ratings of the fuse 102, in one example, four different fuse clips 206 are contemplated each having appropriately dimensioned fuse clip members for Class H(K), J & R cylindrical fuses having current ratings of 100A, 200A, 400A and 600A.

In another embodiment, the fuse clip members 302, 304 may be shaped to engage and receive outer portions of conductive ferrules rather than knife blade contacts 256 as shown.

The base plate 300 is formed integrally with the fuse clip members 302 and 304 and is adapted for interchangeable mounting options to various termination structures using a central mount opening 306 and projections 308, 310. As such, separately provided terminal structures of different varieties can be used with the fuse clip 206.

Figure 11:
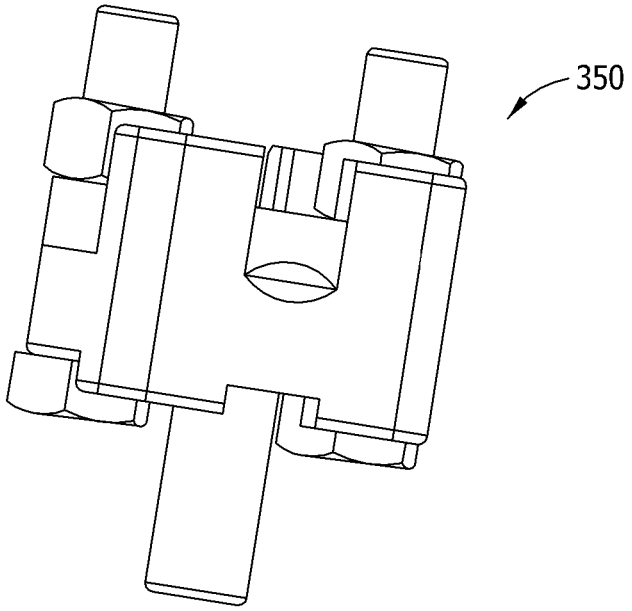
FIG. 11 is a perspective view of a wire clamp terminal that may be used with the fuse clip shown in FIG. 7.

As shown in FIGS. 8-11, exemplary termination options include a box lug terminal 320 (FIG. 8) attachable to the fuse clip base plate 308, a terminal stud assembly 330 (FIG. 9) attachable to the fuse clip base plate 308, a power distribution lug 340 (FIG. 10) attachable to the fuse clip base plate 308, and a wire clamp 350 (FIG. 11). Thus, a good deal of flexibility of termination options is provided to maximize user flexibility in installing the block 200, including simultaneous connection of multiple wires to a single fuse 102 with the power distribution terminal 340. Power distribution terminal concepts are more completely described in U.S. Pat. No. 7,234,968 and will not be separately described herein. While exemplary termination options are shown in FIGS. 8-11, it is recognized that still other terminations exist and may desirably be used, including but not limited to screw terminal connectors, spring cage clamps, and the like.

For each of the termination options, it is contemplated that a set of terminations be made available for use with the respective fuse clips 206 each respectively configured for use with Class H(K), J & R cylindrical fuses having current ratings of 100A, 200A, 400A and 600A. That is, four box lugs 320 would be provided (one for each of the fuse ratings), four terminal stud assemblies 330 would be provided (one for each of the fuse ratings), four power distribution terminals 340 could be provided (one for each of the fuse ratings), and four wire clamps 350 could be provided (one for each of the fuse ratings). Because the terminal options are provided as separate parts from the fuse clips 206, a further reduction in parts relative to the fuse holder 100 (FIG. 24) is possible.

The termination options may be mixed and matched as desired. For example, while FIG. 3 shows box terminal lugs 320 on each of the terminal base sections 222 and 224, one of the box lugs 320 could be replaced with any of the other termination options. That is, the termination options need not be the same for the fuse clips 204 and 206. The fuse clip 204 (FIG. 3) is constructed substantially identically to the fuse clip 206 in the exemplary embodiment shown in FIG. 3, although that need not necessarily be the case in other embodiments.

Figure 12:
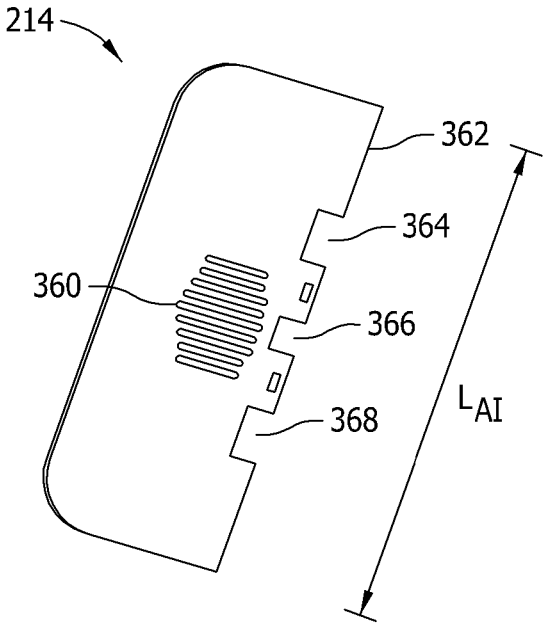
FIG. 12 is a perspective view of an exemplary phase barrier for the fuse block assembly shown in FIGS. 1-3.
Figure 22:
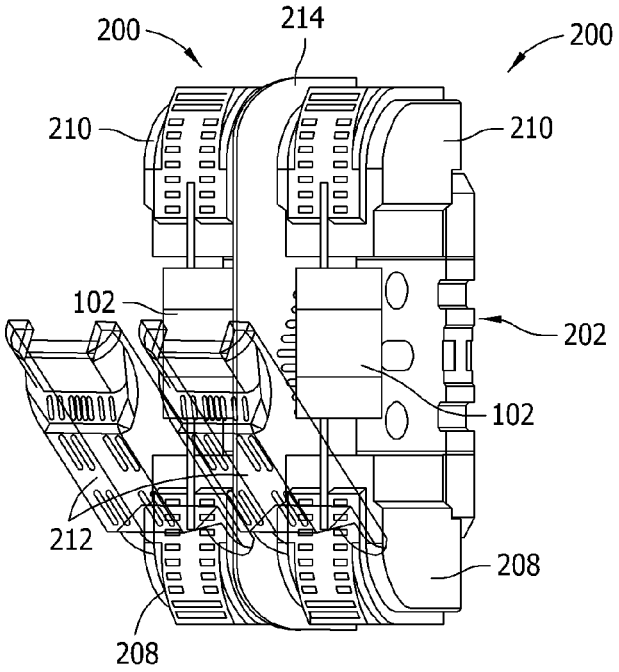
FIG. 22 illustrates a two pole fuse block formed from the fuse blocks shown in FIGS. 1-3.
Figure 23:
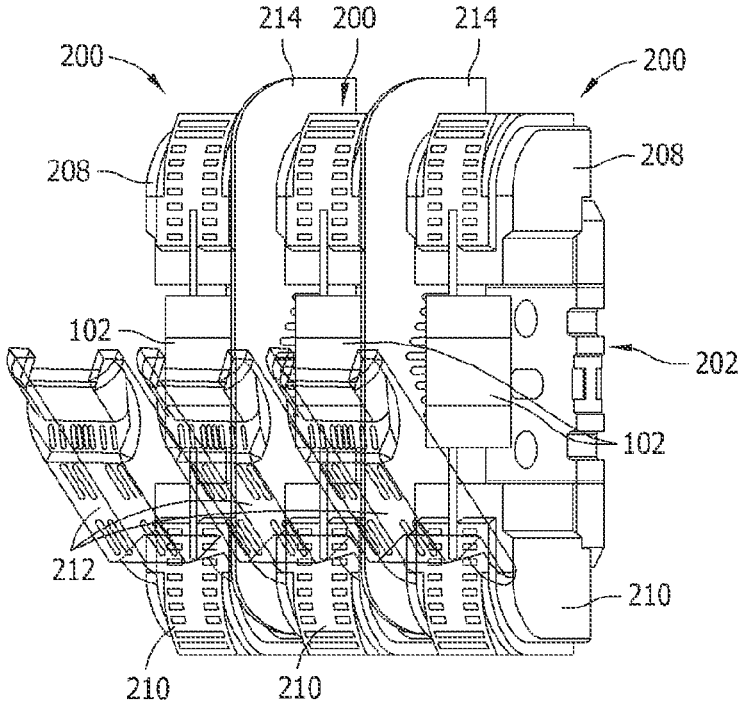
FIG. 23 illustrates a three pole fuse block formed from the fuse blocks shown in FIGS. 1-3.

FIG. 12 is a perspective view of the phase barrier 214 (also shown in FIG. 3). The phase barrier 214 is a generally thin planar element formed from a nonconductive material such as plastic. Ventilation openings 360 are formed in the barrier 214, and a lower periphery 362 of the barrier 214 includes notches 364, 366 that interface with the spacer interconnect 216 (shown in FIGS. 3 and 13). The barrier 214 has an axial length $L_{AT}$ that is longer than the axial length $L_{AB}$ (FIG. 4) of the base assembly 202, and also the axial length $L_{AF}$ (FIG. 3) of the fuse 102. Thus, when the barrier 214 is used in a multi-pole fuse block as shown in FIGS. 22 and 23 with the barrier 214 separating adjacent fuse blocks 200, the barrier 214 extends the entire axial distance of the fuse blocks 200 and then some. The greater axial length $L_{AT}$ as described is not strictly necessary, and in other embodiments, the barrier 214 could have an axial length that is equal to or shorter than the axial length of the base assembly 200 as long as the barrier separates the fuse clips 204, 206 from one another.

Figure 13:
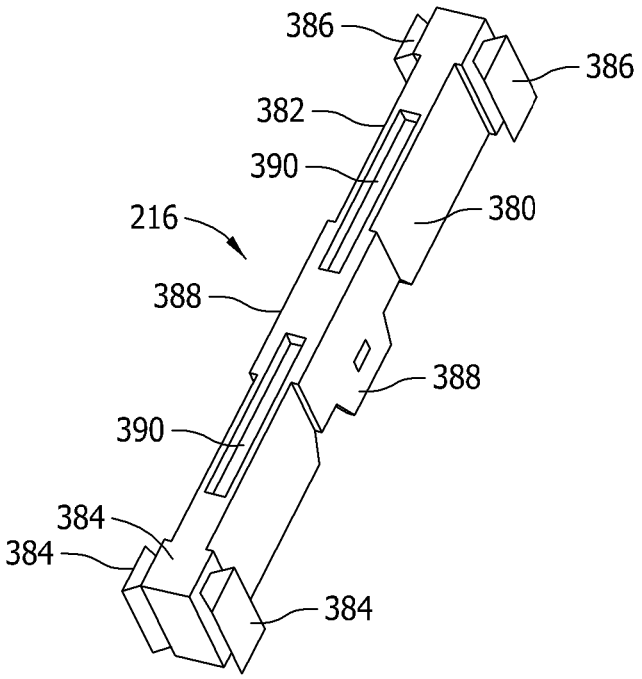
FIG. 13 is a perspective view of an exemplary spacer interconnect element for attaching the modular fuse block shown in FIGS. 1-3 to another fuse block and forming a multi-pole fuse block.

FIG. 13 is a perspective view of the spacer interconnect element 216 allowing attachment of the modular fuse block 100 shown in FIGS. 1-3 to another fuse block 100 as shown in FIGS. 22 and 23 to form multi-pole fuse blocks. In the exemplary embodiment shown, the spacer interconnect element 216 is a thin, elongated element having an axial length approximately equal to the axial length $L_{AB}$ of the base assembly 202 (FIG. 4) and accordingly longer than the axial length $L_{AM}$ of the main base section 220 (FIG. 5). The spacer interconnect 216 includes a first major side 380, a second major side 382, and a top surface 384. The major sides 380, 382 are each provided with tongues or projections 384 and 386 on either side of a central attachment section 388. As such, the major sides 380, 382 are complementary in shape to the longitudinal sides 226, 238 (FIG. 5) of the main base section 220. The spacer interconnect element 216, by virtue of the major sides 380, 382 may therefore engage and interconnect two main base sections 220 in adjacent fuse blocks 100 when multi-pole fuse blocks are formed as shown in FIGS. 22 and 23. Adjacent fuse blocks 100 may therefore be easily attached to one another via the interconnect spacer element 216 that engages the main base sections 220 with sliding, tongue and groove, interlocking assembly.

The spacer interconnect 216 is also formed in the example shown with a thickness approximately equal to the thickness T (FIG. 4) of the base assembly 202 so that the interconnect spacer element 216 generally lies flush with the base assembly 202 when assembled. The width of the interconnect spacer element 216, measured in a direction perpendicular to the length and thickness, is selected to provide a predetermined phase to phase spacing (in the width dimension) of the fuses in a multi-pole arrangement such as those shown in FIGS. 22 and 23. That is, the longitudinal axis $L_{AF}$ of adjacent fuses 102 in the block will be separated by a specified distance from one another when adjacent base assemblies 202 are joined to one another with one of the spacer interconnect elements 216. As one example, four differently dimensioned interconnect spacer elements 216 are contemplated, each having a different width to achieve a predetermined amount of phase to phase spacing for the aforementioned exemplary cylindrical fuses and ratings. UL Specification 4248, for example, provides applicable clearance (through air) and spacing (on the surface) requirements, and the interconnect spacer elements 216 can be configured and dimensioned to ensure that such requirements are met.

While the interconnect spacer elements 216 are believed to be advantageous for the reasons stated, it is recognized that in some embodiments the interconnect elements 216 may be considered optional and may not be utilized.

The top surface 384 of the spacer interconnect element 216 is formed with elongated, axial pockets 390 that receive portions of the notched lower edge 362 of the phase barrier 214. The lower edge 362 of the barrier 214 may therefore be attached to the spacer interconnect element 216 with snap-fit, dead stop engagement to form the multi-pole fuse blocks shown in FIGS. 22 and 23. Different sized barriers 214 are contemplated for the different fuse ratings to achieve varying degrees of surface spacing between adjacent phases. Alternatively, a single barrier 214 that is universally useable with base assemblies of varying size may be adopted. Where acceptable distance through air may be accomplished between live electrical parts for the different phases, such as with the spacer interconnects 216, the barriers 214 could be considered optional and may not be utilized.

Figure 14:
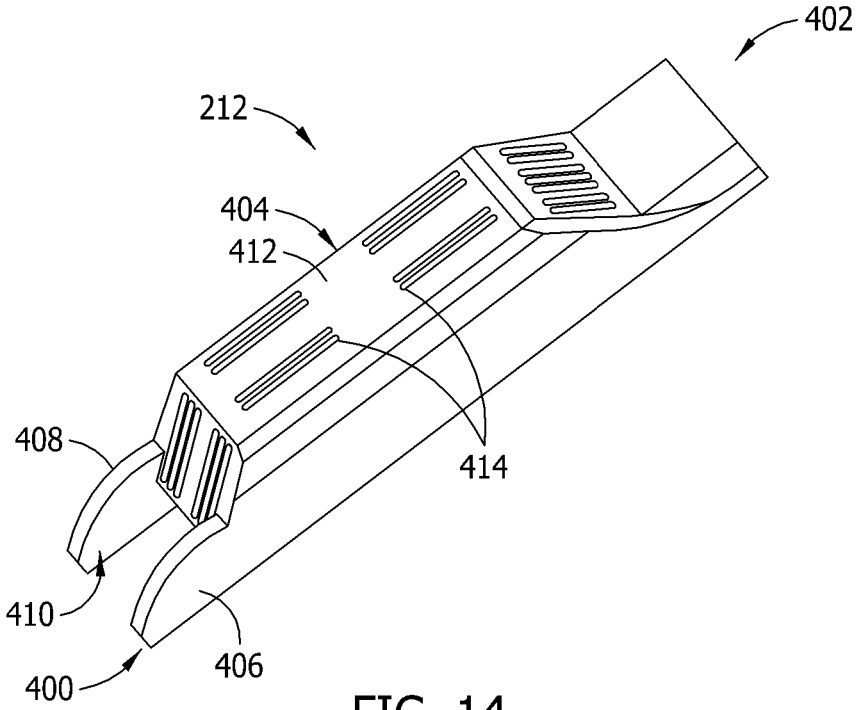
FIG. 14 is a perspective view of an exemplary fuse cover for the fuse block shown in FIGS. 1-3.

FIG. 14 is a perspective view of the exemplary cover 212 for the fuse block 200 (shown in FIGS. 1-3). The cover 212 is fabricated from a suitable nonconductive material known in the art according to known techniques. In the embodiment shown, the cover 212 includes a mounting end 400, a latching end 402 and a main cover section 404 extending therebetween. The mounting end 400 includes substantially parallel mounting arms 406 and 408 extending from one end of the main cover section 404, and inwardly facing mounting pegs 410 are provided on each of the arms 406 and 408. When the pegs 410 are received in mounting apertures provided on a terminal cover 208 (FIGS. 3 and 15), the cover 212 may be pivoted upon the terminal cover 208 to selectively move the cover 212 between the closed position (FIG. 1) and the opened position (FIG. 2).

The latch end 402 extends from an opposing end of the main body section 404 relative to the mounting end 400, and is provided with latching features cooperating with a terminal cover 212 (FIGS. 1-3) to secure the cover 212 in the closed position. Latching of the cover 212, and also the releasing of the cover may be accomplished in any known manner.

The main cover section 404 extends between the mounting end 400 and the latching end 404 and is generally rectangular with a raised upper surface 412, giving the main cover section 102 a dome-like effect. The main cover section 412 is provided with a number of ventilation openings 414 on the upper surface 412 as well as the sides adjacent the mounting and latching ends 400 and 402. The cover 212 may be transparent or translucent, in whole or in part, to allow the fuse 102 (FIGS. 1-3) to be visible through the cover 212 without having to open the cover 212. Particularly when indicating fuses are utilized, transparent covers may allow visual inspection of the fuse to determine its operating state without having to open the cover 212. In case an opaque cover 212 is desired, one or more openings in the cover 212 can be provided to provide similar capability to inspect an indicating fuse without having to open the cover first.

While an exemplary cover 212 is shown, it is contemplated that other cover shapes and configurations having similar or different features may likewise be utilized in alternative embodiments.

A set of covers 212 is contemplated having different axial lengths to span a length of the main base sections 220 of the base assembly 220 between the terminal covers 208 and 210 (FIGS. 1-3) when the cover is closed.

Figure 15:
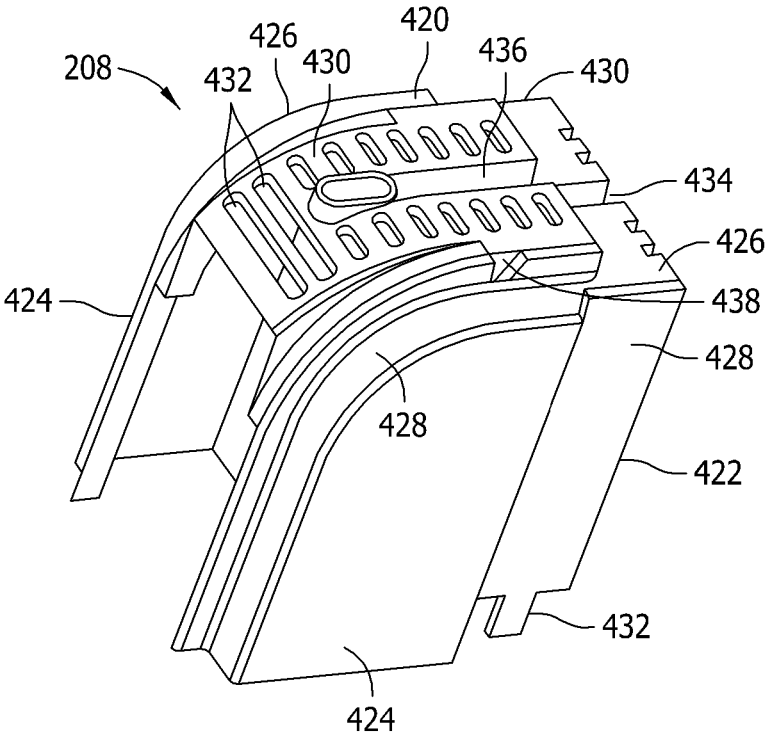
FIG. 15 is a perspective view of an exemplary terminal cover for the fuse block shown in FIGS. 1-3.

FIG. 15 is a perspective view of an exemplary terminal cover 208 for the fuse block 200 (FIGS. 1-3). The terminal cover 208 is fabricated from a nonconductive material such as molded plastic, and is formed into a body 420 having a mount section 422 and shroud sections 424. The mount section 422 has generally rectangular or box-like configuration having an upper surface 426, opposing side surfaces 428, 430, and mounting tabs 432 extending downwardly from each of the side surfaces 428, 430. The mounting tabs 432 are received in the slots 280, 282 (FIG. 6) in the terminal base section 222 as the fuse block 200 is assembled with, for example, snap-fit engagement.

The shroud sections 424 extend laterally outward from the mounting section 422, and include rounded peripheries 426 on the upper edges on either sides of a rounded top surface 430 having a different curvature than the peripheries 426. A number of ventilation openings 432 are formed through the top surface 430. Collectively the mount section 422 and the shroud sections 424 define an enclosure substantially enclosing the fuse clips 204, 206 (FIG. 3) when the fuse block 200 is assembled.

Terminal slots 434, 436 are formed in the respective upper surface 426 of the mount section 422 and the upper surface of the shroud sections 424. The terminal slots 434, 436 in combination define an elongated opening dimensioned to accept insertion of the knife blade contacts 256 (FIG. 3) of the fuse 102 so that the fuse 102 may be installed and removed from the fuse clips 204, 206 without the fuse clips 204, 206 themselves being exposed. That is, the terminal covers 208 and 210, which may be identically constructed but mounted in an opposite orientation to one another, enclose and surround the fuse clips 204, 206 while still allowing insertion and removal of the fuse 102 while the terminal covers 208, 210 remain in place. The fuse clips 204 or 206, which may be energized while the fuse 102 is serviced, are therefore shielded from inadvertent contact, with a user's finger or otherwise, as fuses are removed and replaced in the block 200.

It is contemplated that a set of terminal covers 208, some of which may be used as the terminal covers 210, may be produced and provided with different dimensions corresponding to the fuses having different ratings (and hence different sizes of knife blade contacts) as well as differently dimensioned fuse clips 204, 206 for the different fuse ratings.

Openings 438 are formed in the upper flanges that receive the pegs 410 (FIG. 14) of the fuse cover 212 with, for example, snap fit engagement. The openings 438 define cradles for pivoting movement of the fuse cover 212 upon the pegs 410 between the opened position (FIG. 2) and the closed position (FIG. 1).

Additional features are contemplated to ensure that an appropriate combination of component parts has been selected for assembly for any given application. For example, color coding of the parts, and other features providing similar guidance, may be utilized to ensure that for example, a rating of the fuse clips 204, 206 appropriately corresponds to a rating of the base assembly 220. As another example, such features could be utilized to determine that the ratings of the exemplary terminal elements (FIGS. 8-11) appropriately correspond to the ratings of the fuse clips 204, 206 as fuse blocks are assembled. In other words, mis-matching of the modular components can be problematic and should be avoided, and providing some guidance to assemblers with built-in features of the components may be desirable. Such guidance could be provided with colors, graphics, symbols, stampings, molded-in indicia, or in another manner in which persons assembling the fuse blocks can quickly and easily determine matching components or identify mis-matching of components.

Figure 16:
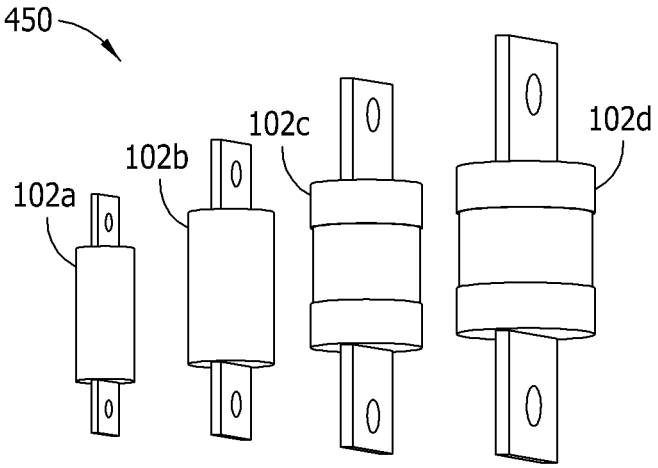
FIG. 16 illustrates a first set of fuses for which the fuse block assembly shown in FIGS. 1-3 may be configured.

FIGS. 16-25 illustrate method aspects of configuring the fuse blocks 200 using the modular components as described. FIG. 16 illustrates a first exemplary set 450 of fuses for which the fuse block assembly 200 (FIGS. 1-3) may be configured. The set 450 of fuses shown in FIG. 16 includes Class J, 600 V fuses 102*a*, 102*b*, 102*c*, 102*d* having different current ratings. Fuse 102*a* has a current rating of 100A. Fuse 102*b* has a current rating of 200A. Fuse 102*c* has a current rating of 400A. Fuse 102*d* has a current rating of 600A. As is evident from FIG. 16, as the current rating increases, the physical package of the fuses 102 increases, including but not limited to the diameter of the cylindrical body, the axial length of the fuse body, the size of the knife blade contacts, and the overall axial length.

Figure 17:
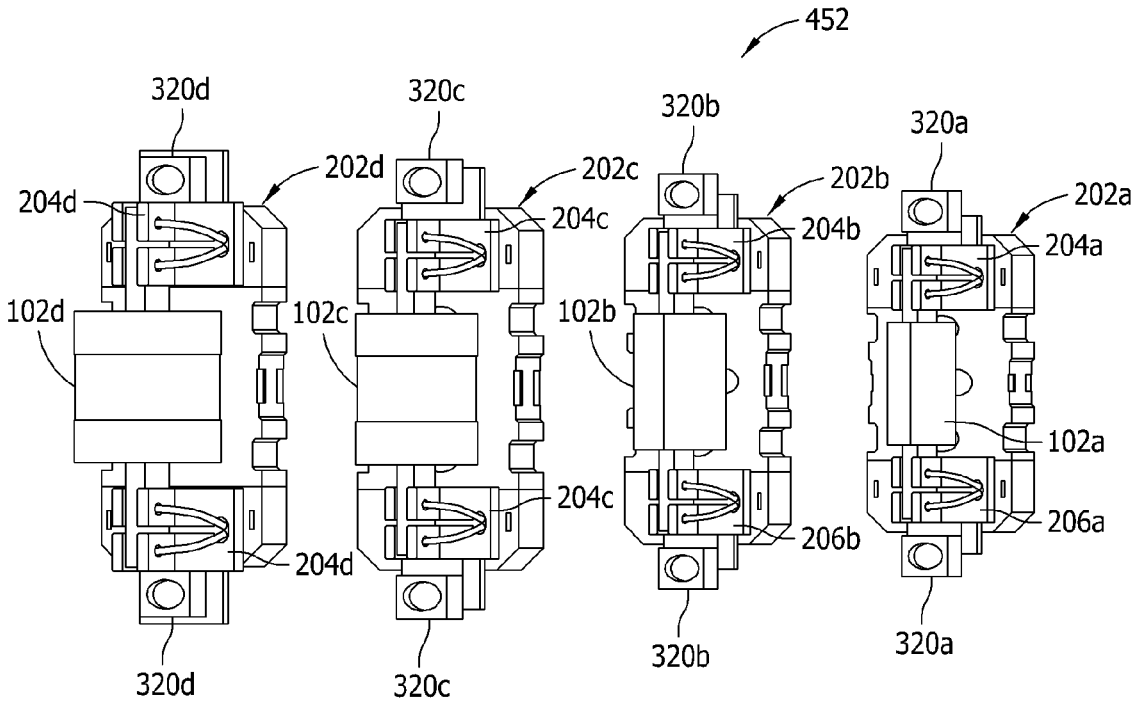
FIG. 17 illustrates partial assembly views of modular fuse blocks configured for the set of fuses shown in FIG. 16.

FIG. 17 shows a set 452 of base assemblies 202 assembled to accommodate the set 450 of fuses shown in FIG. 16. The base assembly 202*a* includes a main base section 220 (FIGS. 4 and 5) and terminal base sections 222, 224 (FIGS. 4 and 6) having respective axial lengths that, when assembled, accommodate the fuse 102*a*. The base assembly 202*b* includes a main base section 220 and terminal base sections 222, 224 having respective axial lengths that, when assembled, accommodate the fuse 102*b*. The base assembly 202*c* includes a main base section 220 and terminal base sections 222, 224 having respective axial lengths that, when assembled, accommodate the fuse 102*c*. The base assembly 202*d* includes a main base section 220 and terminal base sections 222, 224 having respective axial lengths that, when assembled, accommodate the fuse 102*d*. The reader is referred back to Table 1 above for specific exemplary main base sections 220 and terminal base sections 222, 224 for each of the fuses 102*a*, 102*b*, 102*c*, 102*d*.

As also shown in FIG. 17, each of the base assemblies 202*a*, 202*b*, 202*c* and 202*d* are provided, for each of the current ratings, with appropriate fuse clips 204*a*, 206*a*, 204*b*, 206*b*, 204*c*, 206*c*, 204*d* and 206*d* on the respective terminal base sections. Further, box lug terminals 320*a*, 320*b*, 320*c* and 320*d* with appropriate dimensions for the current ratings have been selected and are coupled to the fuse clips as described above. The assembly of the blocks 200 shown in FIG. 17 may be completed by installing terminal covers 208, 210 (FIGS. 1-3 and 15) appropriate for each fuse rating, and installing the fuse covers 212 (FIGS. 1-3 and 14) as also described above.

Figure 18:
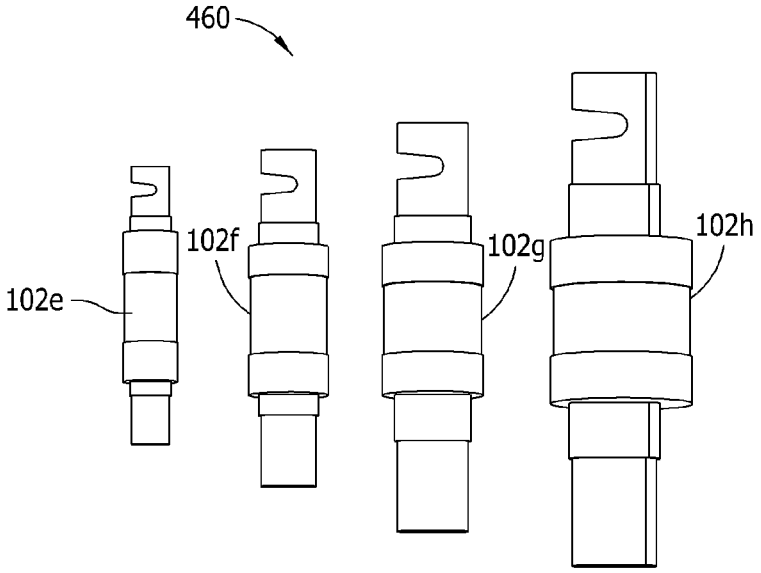
FIG. 18 illustrates a second set of fuses for which the fuse block assembly shown in FIGS. 1-3 may be configured.

FIG. 18 illustrates a second exemplary set 460 of fuses for which the fuse block assembly 200 (FIGS. 1-3) may be configured. The set 460 of fuses shown in FIG. 18 includes Class R & H, 250 V fuses 102*e*, 102*f*, 102*g*, 102*h* having different current ratings. Fuse 102*e* has a current rating of 100A. Fuse 102*f* has a current rating of 200A. Fuse 102*g* has a current rating of 400A. Fuse 102*h* has a current rating of 600A. As is evident from FIG. 18, as the current rating increases, the physical package of the fuses 102 increases, including but not limited to the diameter of the cylindrical body, the axial length of the fuse body, the size of the knife blade contacts, and the overall axial length.

Figure 19:
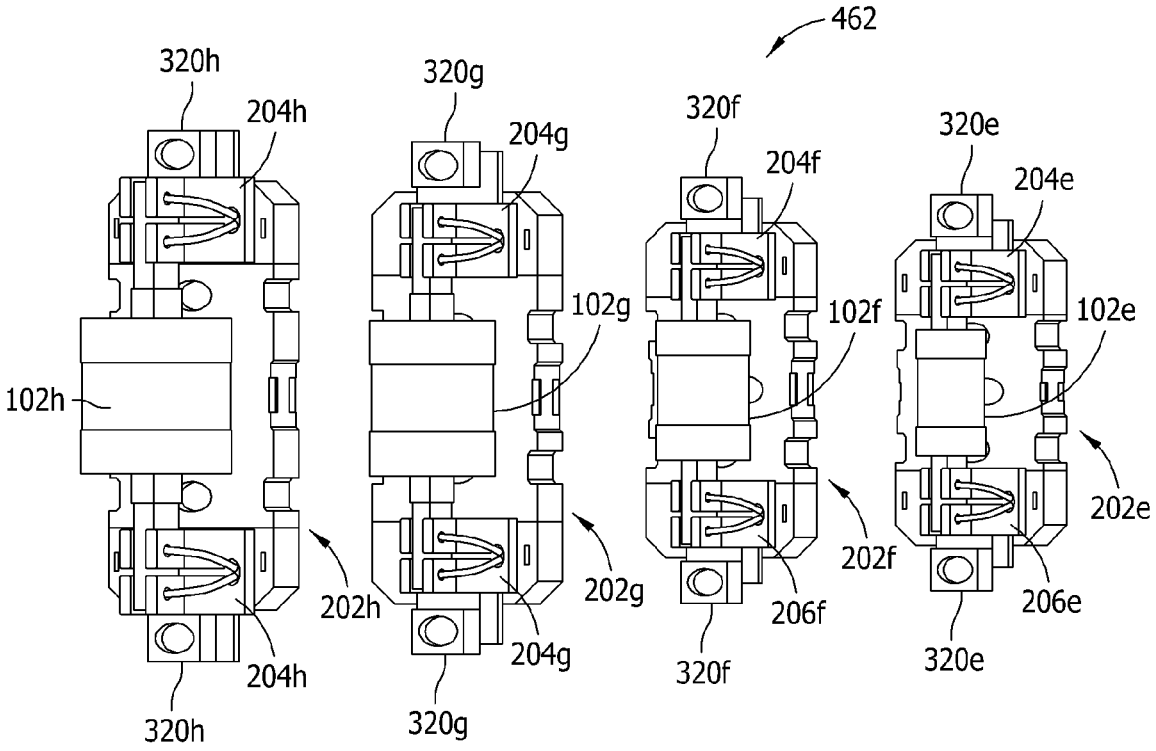
FIG. 19 illustrates partial assembly views of modular fuse blocks configured for the set of fuses shown in FIG. 18.

FIG. 19 shows a set 462 of base assemblies 202 assembled to accommodate the set 460 of fuses shown in FIG. 18. The base assembly 202*e* includes a main base section 220 (FIGS.

4 and 5) and terminal base sections 222, 224 (FIGS. 4 and 6) having respective axial lengths that, when assembled, accommodate the fuse 102*e*. The base assembly 202*f* includes a main base section 220 and terminal base sections 222, 224 having respective axial lengths that, when assembled, accommodate the fuse 102*f*. The base assembly 202*g* includes a main base section 220 and terminal base sections 222, 224 having respective axial lengths that, when assembled, accommodate the fuse 102*g*. The base assembly 202*h* includes a main base section 220 and terminal base sections 222, 224 having respective axial lengths that, when assembled, accommodate the fuse 102*h*. The reader is referred back to Table 1 above for specific exemplary main base sections 220 and terminal base sections 222, 224 for each of the fuses 102*e*, 102*f*, 102*g*, 102*h*. It should be noted that the main base sections 220 and the terminal base sections 222 and 224 used to assembled the base assemblies 202*e*, 202*f*, 202*g*, and 202*h* represent some of the same modular sections used to create the base assemblies 202*a*, 202*b*, 202*c* and 202*d* in FIG. 17.

As also shown in FIG. 19, each of the base assemblies 202*e*, 202*f*, 202*g* and 202*h* are provided, for each of the current ratings, with appropriate fuse clips 204*e*, 206*e*, 204*f*, 206*f*, 204*g*, 206*g*, 204*h* and 206*h* on the terminal base sections. Further, box lug terminals 320*e*, 320*f*, 320*g* and 320*g* with appropriate dimensions for the current ratings have been selected and are coupled to the fuse clips as described above. It should be noted that the fuse clips and box lug terminals represented in FIG. 19 represent some of the same modular fuse clips and modular box lug terminals shown FIG. 17.

The assembly of the blocks 200 shown in FIG. 19 may be completed by installing terminal covers 208, 210 (FIGS. 1-3 and 15) appropriate for each fuse rating, and installing the fuse covers 212 (FIGS. 1-3 and 14) as also described above.

Figure 20:
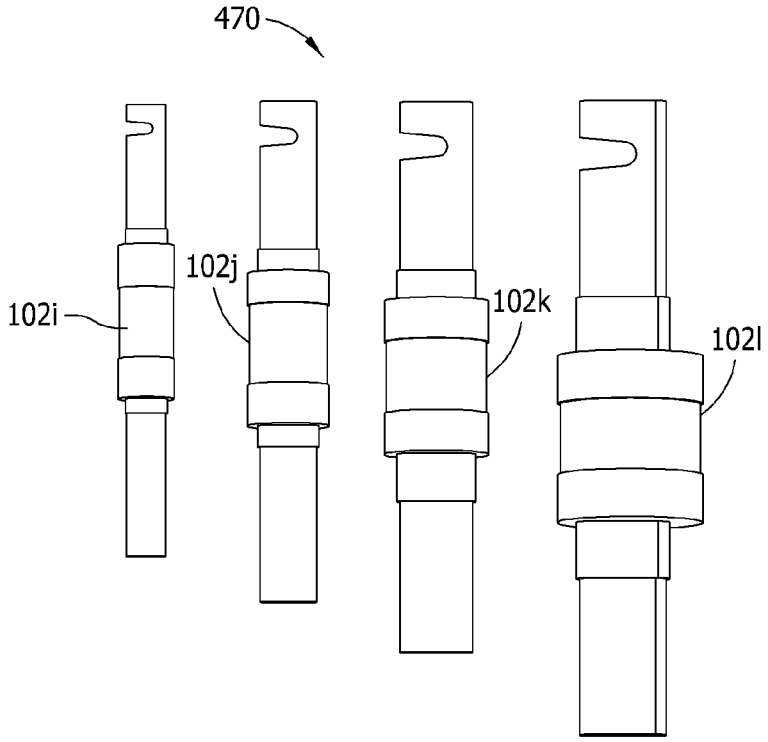
FIG. 20 illustrates a third set of fuses for which the fuse block assembly shown in FIGS. 1-3 may be configured.

FIG. 20 illustrates a third exemplary set 470 of fuses for which the fuse block assembly 200 (FIGS. 1-3) may be configured. The set 470 of fuses shown in FIG. 20 includes Class R & H, 600 V fuses 102*i*, 102*j*, 102*k*, 102*l* having different current ratings. Fuse 102*i* has a current rating of 100A. Fuse 102*j* has a current rating of 200A. Fuse 102*k* has a current rating of 400A. Fuse 102*l* has a current rating of 600A. As is evident from FIG. 20, as the current rating increases, the physical package of the fuses 102 increases, including but not limited to the diameter of the cylindrical body, the axial length of the fuse body, the size of the knife blade contacts, and the overall axial length.

Figure 21:
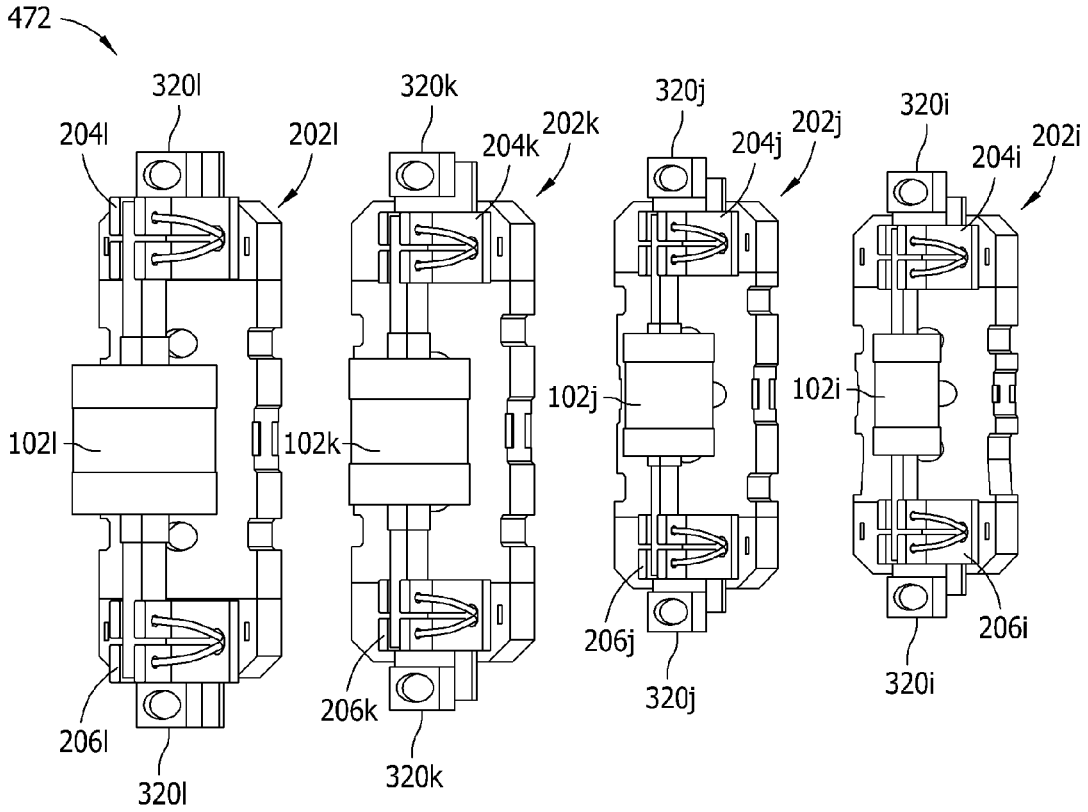
FIG. 21 illustrates partial assembly views of modular fuse blocks configured for the set of fuses shown in FIG. 20.

FIG. 21 shows a third exemplary set 472 of base assemblies 202 assembled to accommodate the set 470 of fuses shown in FIG. 20. The base assembly 202*i* includes a main base section 220 (FIGS. 4 and 5) and terminal base sections 222, 224 (FIGS. 4 and 6) having respective axial lengths that, when assembled, accommodate the fuse 102*i*. The base assembly 202*j* includes a main base section 220 and terminal base sections 222, 224 having respective axial lengths that, when assembled, accommodate the fuse 102*j*. The base assembly 202*k* includes a main base section 220 and terminal base sections 222, 224 having respective axial lengths that, when assembled, accommodate the fuse 102*k*. The base assembly 202*l* includes a main base section 220 and terminal base sections 222, 224 having respective axial lengths that, when assembled, accommodate the fuse 102*l*. The reader is referred back to Table 1 above for specific exemplary main base sections 220 and terminal base sections 222, 224 for each of the fuses 102*i*, 102*j*, 102*k*, 102*l*. It should be noted that the main base sections 220 and the terminal base sections 222 and 224 used to assembled the base assemblies 202*i*, 202*j*, 202*k*, and 202*l* represent some of the same modular sections used to create the base assemblies 202*a*, 202*b*, 202*c* and 202*d* in FIGS. 17 and 202*e*, 202*f*, 202*g* and 202*h* in FIG. 19.

As also shown in FIG. 21, each of the base assemblies 202*i*, 202*j*, 202*k* and 202*l* are provided, for each of the current ratings, with appropriate fuse clips 204*i*, 206*i*, 204*j*, 206*j*, 204*k*, 206*k*, 204*l* and 206*l* on the terminal base sections. Further, box lug terminals 320*i*, 320*j*, 320*k* and 320*l* with appropriate dimensions for the current ratings have been selected and are coupled to the fuse clips as described above. It should be noted that the fuse clips and box lug terminals represented in FIG. 21 represent some of the same modular fuse clips and modular box lug terminals shown FIGS. 17 and 19.

The assembly of the blocks 200 shown in FIG. 21 may be completed by installing terminal covers 208, 210 (FIGS. 1-3 and 15) appropriate for each fuse rating, and installing the fuse covers 212 (FIGS. 1-3 and 14) as also described above.

As the blocks 200 are configured, using the spacer interconnect elements 216 and phase barriers 214, multi-pole fuseblocks can be assembled as shown in FIGS. 22 and 23. FIG. 22 illustrates a two pole fuse block formed from the fuse blocks 200 (FIGS. 1-3). FIG. 23 illustrates a three pole fuse block formed from the fuse blocks 200 (FIGS. 1-3). In each case, the spacer interconnect elements 216 attaches adjacent base assemblies 202 of the fuse blocks 100, and the phase barriers 214 separates adjacent fuses 102 from one another in the multi-pole blocks shown. Still greater numbers of poles could be added with additional fuse blocks, spacer interconnect elements and phase barriers.

Figure 25:
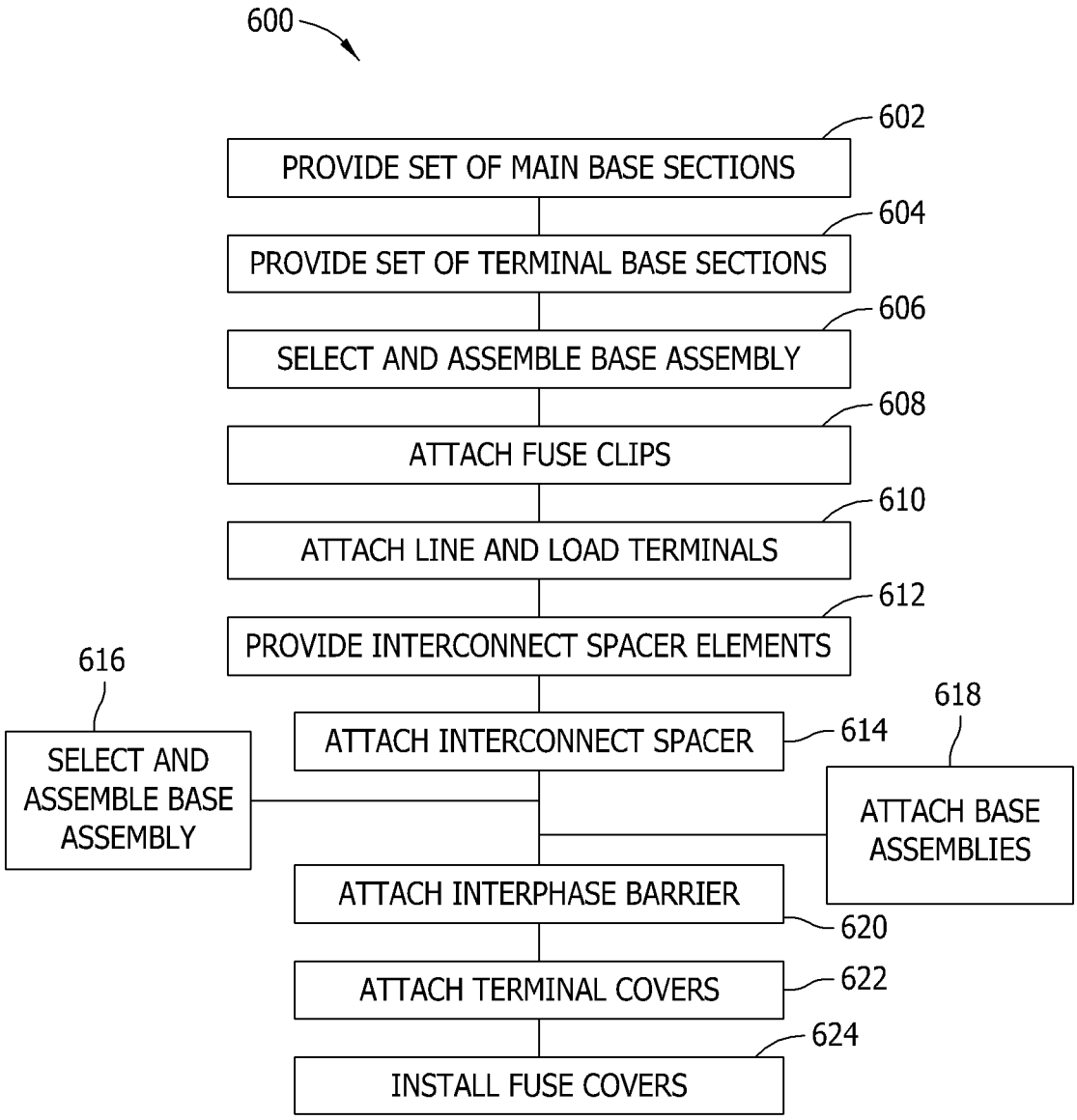
FIG. 25 is an exemplary method flowchart for configuring the fuse blocks shown in FIGS. 1-3 and 22-23.

FIG. 25 is an exemplary flowchart of a method 600 of configuring fuseblocks for a selected one of a plurality of overcurrent protection fuses having different ratings and axial lengths, such as any of the fuses in the exemplary sets discussed above wherein each of the fuses each include a cylindrical body defining a longitudinal axis and conductive terminal elements attached to opposing ends of the cylindrical body. The exemplary method includes, as shown at step 602, providing a set of main base sections having different axial lengths, and at step 604, providing a set of terminal base sections different from the main base sections. The main base sections may be, for example, the sections 220 described above and the terminal base sections may be the terminal sections 222 and 224 described above. As used herein, "providing" shall include, but not be limited to the manufacture of the sets of base sections. All that is necessary is for the sets to be made available to perform other steps described, which may be performed by non-manufacturing entities.

At step 606, a pair of the terminal base sections are selected and assembled to a selected one of the set of main base sections to form a first base assembly having an overall axial length of the assembled sections at least equal to the axial length of the selected fuse. The base assembly may be the assembly 202 described above.

At step 608, line and load side fuse clips may be attached to the pair of terminal base sections, the line and load fuse clips configured to engage the respective terminal elements of the selected fuse with the cylindrical body positioned between the line and load side fuse clips. The fuse clips may be the fuse clips 204, 206 described above.

At step 610, one of a plurality of line and load side terminals (e.g., any of the terminals shown in FIGS. 8-11 or otherwise known) may be attached to the line and load side fuse clips as described above. As noted above, the line and load side terminal elements are separately provided from the line and load side fuse clips and are interchangeably attachable the line and load side fuse clips.

At the completion of step 610, a functional first fuse block has been configured.

If a multi-pole fuse block is desired, the method may also include, as shown at step 612, providing an interconnect spacer element such as the element 216 described above, and at step 614, attaching the interconnect spacer element to the main section of the first base assembly formed at step 606. As described above, a second base assembly can be assembled (by repeating the steps described above) at step 616 and attached to the interconnect spacer element at step 618, joining the two base assemblies.

The method may also include, as shown at step 620, attaching a phase barrier to the assembled main base section and terminal base section. The barrier, which may the barrier 214 described above, separates the phases of the multi-fuse block from one another and enhances safety of the fuse block.

At step 622, terminal covers may be attached to the terminal base sections to substantially enclose the first and second fuse clips. The terminal covers may be the covers 208 and 210 described above.

At step 624, fuse covers, such as the covers 212 described above, may be installed.

The fuse block is now complete, and the line and load side connections may be established using, for example, any of the techniques described herein and known in the art. The fuses, such as the fuses 102, may be installed to provide overcurrent protection to load side circuits.

It should be understood that not all of the steps described may be performed in all cases, nor should the steps necessarily be performed in the order described. While exemplary fuses 102 have been described, it is recognized that other types of fuses may be used with similar benefits, such as square bodied fuses that are also known in the art. Additionally, the conductive terminal elements of the selected fuses need not include knife blade terminals as shown in the Figures, but rather may be ferrules as those in the art would appreciate. Finally, while exemplary fuses and ratings are disclosed, they are provided primarily for the sake of illustration rather than limitation. Fuses of other classes and ratings may benefit from the modular approach taught herein and may fall within the scope of properly construed claims.

The advantages and benefits of the invention are now believed to apparent from the forgoing exemplary embodiments disclosed.

An embodiment of a modular fuse block assembly configurable for more than one of a plurality of overcurrent protection fuses having different ratings and axial lengths has been disclosed. The plurality of overcurrent protection fuses each include a nonconductive body defining a longitudinal axis, first and second conductive terminal elements attached to opposing ends of the body, and an axial length measured parallel to the longitudinal axis and including the first and second terminal element. The fuse block includes at least a first configurable base assembly having a plurality of modular base sections fabricated from a nonconductive material and having respective axial lengths. The modular base sections are attachable to one another to form the first configurable base assembly having an overall axial length equal to the sum of the respective axial lengths of plurality of modular base sections, and the overall axial length of the base assembly being equal to or greater than the overall axial length of the fuse. Line and load side fuse clips are respectively coupled to first and second ones of the plurality of modular base sections, wherein when the modular base sections are attached the line and load side fuse clips are spaced apart to respectively engage the first and second terminal elements of the fuse while accommodating the body therebetween. A plurality of line and load side terminals are separately provided from the line and load side fuse clips, with the line and load side terminals being interchangeably attachable to the line and load side fuse clips.

Optionally, the separately provided line and load side terminals are selected from the group of a terminal stud, a box lug, a power distribution lug, a wire clamp, and equivalents and combinations thereof.

The modular base sections and the terminal base sections may be configured for tongue and groove engagement, and the modular base sections may include a main base section fabricated from a nonconductive material and having a first axial length shorter than an overall axial length of a selected one of the plurality of fuses, and opposing terminal base sections fabricated from a nonconductive material and each having respective second and third axial length. The terminal base sections may be separately provided from the main base section, and the terminal base sections may be attachable to the main base section to form the first nonconductive base assembly having an overall axial length equal to the sum of the first axial length of the main section and the second and third axial lengths of the terminal base portions.

The main base section optionally is generally planar and has a first thickness. The terminal base sections may be generally planar and have a second thickness, with the first and second thickness being substantially equal to one another. At least one of the second and third axial length may be shorter than the first axial length, and the second and third axial lengths may be equal. The main base section may include an elongated body having longitudinal sides extending parallel to the first axial length and lateral sides extending perpendicular to the first axial length, with the lateral sides configured for removable attachment to the terminal base sections. The longitudinal sides may be configured for attachment to a second nonconductive base assembly.

An optional elongated spacer interconnect element may be configured to attach to a longitudinal side of the main base section. The elongated spacer interconnect element may be configured to attach to a second nonconductive base assembly. A phase barrier may be attachable to the elongated spacer interconnect element. The phase barrier element may have an axial length greater than the overall axial length of the base assembly, and may include at least one vent opening extending therethrough.

The terminal base sections may optionally be formed as mirror images of one another. The first and second terminal elements of the fuse may include one of knife blade terminals and ferrules. First and second terminal covers may substantially enclose the line and load side fuse clips.

An optional fuse cover may be attached to at least one of the terminal covers, with the fuse cover movable between an opened position and a closed position, and the fuse cover extending over the body of the selected fuse in the closed position. The fuse cover may be pivotally attached to one of the terminal covers. The fuse cover may be transparent.

The base assembly may consist of three assembled base sections, and at least two of the three base sections may have different axial lengths. The body of the fuse may be one of a cylindrical body and a square body.

An exemplary method of configuring a modular fuse block assembly for a selected one of a plurality of overcurrent protection fuses having different ratings and axial lengths is also disclosed. The plurality of overcurrent protection fuses each include a body defining a longitudinal axis and conductive terminal elements attached to opposing ends of the body. The method includes: providing a set of main base sections having different axial lengths; providing a set of terminal base sections having different axial lengths; selecting and assembling a pair of the terminal base sections to one of the set of main base sections to form a first base assembly having an overall axial length of the assembled sections at least equal to the axial length of the selected fuse; attaching line and load side fuse clips to the pair of terminal base sections, the line and load fuse clips configured to engage the respective terminal elements of the selected fuse with the body positioned between the line and load side fuse clips; and attaching one of a plurality of line and load side terminal elements to the line and load side fuse clips. The line and load side terminal elements being separately provided from the line and load side fuse clips and are interchangeably attachable the line and load side fuse clips, thereby forming a first fuse block.

The method may further include attaching a phase barrier to the assembled main base section and terminal base section, providing an interconnect spacer element, and attaching the interconnect spacer element to the main section.

Also in the method, a second fuse block may be configured by repeating the steps described above, and the method may include attaching the first and second fuse blocks with the interconnect spacer element.

The method may optionally include attaching terminal covers to the terminal base sections to substantially enclose the first and second fuse clips.

The conductive terminal elements of the selected fuse in the method may include one of knife blade terminals and ferrules. The plurality of line and load side terminals may be selected from the group of a terminal stud, a box lug, a power distribution lug, a wire clamp, and equivalents and combinations thereof.

Another embodiment of a modular fuse block assembly for at least one overcurrent protection fuse has been disclosed. The fuse has a nonconductive body defining a longitudinal axis, first and second conductive terminal elements attached to opposing ends of the body, and an axial length measured parallel to the longitudinal axis and including the first and second terminal elements. The modular fuse block includes: at least one base section having a dimension selected to accommodate the axial length of the overcurrent protection fuse; line and load side fuse clips respectively coupled to first and second ones of the plurality of modular base sections, wherein when the modular base sections are attached the line and load side fuse clips are spaced apart to respectively engage the first and second terminal elements of the fuse while accommodating the body therebetween; and first and second terminal covers separately provided from but attached to the base, each terminal cover defining an opening dimensioned to receive the first and second conductive terminal elements of the overcurrent protection fuse; wherein the fuse may be installed and removed from the line and load side fuse clips while the first and second terminal covers remain in place.

Optionally, the fuse block may further include a fuse cover attached to at least one of the first and second terminal covers. The cover may be translucent and may further be pivotally attached to one of the terminal covers. At least one spacer interconnect may also be provided, and the spacer interconnect element may be attachable to the at least one base section. At least one phase barrier may also be provided and may be attachable to the at least one base section. A second base section may further be provided and may be attachable to the spacer interconnect element. Line and load side terminals may be separately provided the line and load side fuse clips, with the line and load side terminals being selected from the group of a terminal stud, a box lug, a power distribution lug, a wire clamp, and equivalents and combinations thereof. Any of the line and load side terminals in the group may be interchangeably used with the line and load side fuse clips.

The at least one base section may have a substantially constant thickness. The at least one base section may further include at least a first base section having a first axial length and a second base section having a second axial length, the first and second base sections assembled to one another to provide a third axial length. The first axial length may be different from the second axial length.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuse block configurable for more than one of a plurality of overcurrent protection fuses having different ratings and axial lengths, the plurality of overcurrent protection fuses each including a nonconductive body defining a longitudinal axis, first and second conductive terminal elements attached to opposing ends of the body, and an axial length measured parallel to the longitudinal axis and including the first and second terminal elements, the fuse block comprising:

at least a first configurable base assembly comprising:

at least three modular base sections fabricated from a nonconductive material and having respective axial lengths, the modular base sections attachable to one another to form the first configurable base assembly having an overall axial length equal to the sum of the respective axial lengths of at least three modular base sections each having an axial length less than the axial length of a selected one of plurality of overcurrent protection fuses, the overall axial length of the base assembly being equal to or greater than the overall axial length of the selected one of the plurality of overcurrent protection fuses;

line and load side fuse clips respectively coupled to first and second ones of the plurality of modular base sections, wherein when the modular base sections are attached the line and load side fuse clips are spaced apart to respectively engage the first and second terminal elements of the fuse while accommodating the body of the selected one of the plurality of overcurrent protection fuses therebetween; and a plurality of line and load side terminals separately provided from the line and load side fuse clips, the line and load side terminals being interchangeably attachable to the line and load side fuse clips.

2. The fuse block of claim 1, wherein the separately provided line and load side terminals are selected from the group of a terminal stud, a box lug, a power distribution lug, a wire clamp, and equivalents and combinations thereof.

3. The fuse block of claim 1, wherein the at least three modular base sections are configured for tongue and groove engagement with one another.

4. The fuse block of claim 1, wherein the at least three modular base sections comprise:

a main base section fabricated from a nonconductive material and having a first axial length shorter than an overall axial length of a selected one of the plurality of fuses; and a pair of opposing terminal base sections fabricated from a nonconductive material and each having a respective second and third axial length, the terminal base sections being separately provided from the main base section, the terminal base sections attachable to the main base section to form the first nonconductive base assembly having an overall axial length equal to the sum of the first axial length of the main section and the second and third axial lengths of the terminal base portions.

5. The fuse block of claim 4, wherein the main base section is generally planar and has a first thickness.

6. The fuse block of claim 5, wherein the terminal base sections are generally planar and have a second thickness, the first and second thickness being substantially equal to one another.

7. The fuse block of claim 4, wherein at least one of the second and third axial length is shorter than the first axial length.

8. The fuse block of claim 4, wherein the main base section includes an elongated body having longitudinal sides extending parallel to the first axial length and lateral sides extending perpendicular to the first axial length, the lateral sides configured for removable attachment to the terminal base sections.

9. The fuse block of claim 8, wherein the longitudinal sides are configured for attachment to a second nonconductive base assembly.

10. The fuse block of claim 4, wherein the second and third axial lengths are equal.

11. The fuse block of claim 4, further comprising an elongated spacer interconnect element configured to attach to a longitudinal side of the main base section.

12. The fuse block of claim 11, wherein the elongated spacer interconnect element is configured to attach to a second nonconductive base assembly.

13. The fuse block of claim 11, further comprising a phase barrier attachable to the elongated spacer interconnect element.

14. The fuse block of claim 13, wherein the phase barrier has an axial length greater than the overall axial length of the base assembly.

15. The fuse block of claim 13, wherein the phase barrier includes at least one vent opening extending therethrough.

16. The fuse block of claim 4, wherein the terminal base sections are formed as mirror images of one another.

17. The fuse block of claim 1, wherein the first and second terminal elements of the selected one of the plurality of overcurrent protection fuses comprise one of knife blade terminals and ferrules.

18. The fuse block of claim 1, further comprising first and second terminal covers substantially enclosing the line and load side fuse clips.

19. The fuse block of claim 18, further comprising a fuse cover attached to at least one of the first and second terminal covers, the fuse cover movable between an opened position and a closed position, the fuse cover extending over the body of the selected fuse in the closed position.

20. The fuse block of claim 19, wherein the fuse cover is pivotally attached to one of the first and second terminal covers.

21. The fuse block of claim 19, wherein the fuse cover is transparent.

22. The fuse block of claim 1, wherein at least two of the at least three modular base sections have different axial lengths.

23. The fuse block of claim 1, wherein the body of the selected one of the plurality of overcurrent protection fuses is one of a cylindrical body and a square body.

24. The fuse block of claim 1, wherein the at least three modular base sections include at least two modular base sections having an equal axial length.

25. The fuse block of claim 1, wherein the at least three modular base sections include at least two modular base sections having different axial lengths.

26. A modular fuse block assembly for at least one overcurrent protection fuse having a nonconductive body defining a longitudinal axis, first and second conductive terminal elements attached to opposing ends of the body, and an axial length measured parallel to the longitudinal axis and including the first and second terminal elements, the modular fuse block comprising:

a configurable base having a dimension selected to accommodate the axial length of the overcurrent protection fuse, the configurable base comprising an assembly of at least three modular base sections, and at least two of the modular base sections having respectively different axial lengths;

line and load side fuse clips respectively coupled to the configurable base, wherein when the plurality of modular base sections are attached the line and load side fuse clips are spaced apart to respectively engage the first and second terminal elements of the fuse while accommodating the body therebetween; and first and second terminal covers separately provided from but attached to the configurable base, each of the first and second terminal covers defining an opening dimensioned to receive the first and second conductive terminal elements of the overcurrent protection fuse;

wherein the overcurrent protection fuse may be installed and removed from the line and load side fuse clips while the first and second terminal covers remain in place.

27. The fuse block of claim 26, further comprising a fuse cover attached to at least one of the first and second terminal covers.

28. The fuse block of claim 27 wherein the fuse cover is translucent.

29. The fuse bock of claim 27, wherein the fuse cover is pivotally attached to one of the terminal covers.

30. The fuse block of claim 26, further comprising at least one spacer interconnect element attachable to the configurable base.

31. The fuse block of claim 30, further comprising at least one phase barrier attachable to the configurable base.

32. The fuse block of claim 30, further comprising a second base attachable to the spacer interconnect element.

33. The fuse block of claim 26, further comprising line and load side terminals separately provided from the line and load side fuse clips, the line and load side terminals being selected from the group of a terminal stud, a box lug, a power distribution lug, a wire clamp, and equivalents and combinations thereof.

34. The fuse block of claim 33, wherein any of the line and load side terminals in the group are interchangeably used with the line and load side fuse clips.

35. The fuse block of claim 26 wherein the each of the at least three modular base sections of the configurable base has a substantially constant thickness.

36. The fuse block of claim 26, wherein the at least three modular base sections includes at least a main base section having a first axial length and a terminal base section having a second axial length different from the first axial length, the first and second base sections assembled to one another to provide a third axial length.

37. The fuse block of claim 36, wherein the first axial length is longer than the second axial length.

38. The fuse block of claim 37, wherein the first axial length is longer than an axial length of the fuse body.

39. The fuse block of claim 26, wherein the at least three modular base sections comprises a first base section having a first axial length, and second and third base sections each having a second axial length.

40. The fuse block of claim 39, wherein the second and third base sections are attachable to opposing ends of the first base section.

41. The fuse block of claim 26, wherein at least two of the modular base sections have an equal axial length.

* * * * *